US011296400B2

(12) United States Patent
Yamagajo et al.

(10) Patent No.: US 11,296,400 B2
(45) Date of Patent: Apr. 5, 2022

(54) ANTENNA DEVICE

(71) Applicant: FUJITSU LIMITED, Kawasaki (JP)

(72) Inventors: Takashi Yamagajo, Yokosuka (JP); Yohei Koga, Kawasaki (JP); Manabu Yoshikawa, Yokohama (JP); Tabito Tonooka, Kawasaki (JP); Hirotake Sumi, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 217 days.

(21) Appl. No.: 16/374,255

(22) Filed: Apr. 3, 2019

(65) Prior Publication Data

US 2019/0341675 A1 Nov. 7, 2019

(30) Foreign Application Priority Data

May 7, 2018 (JP) ..... JP2018-089427

(51) Int. Cl.

| | |
|---|---|
| ***H01Q 1/48*** | (2006.01) |
| ***H01Q 7/00*** | (2006.01) |
| ***H01Q 5/10*** | (2015.01) |
| ***H01Q 9/42*** | (2006.01) |
| ***H01Q 1/24*** | (2006.01) |
| ***H01Q 1/38*** | (2006.01) |
| ***H01Q 13/08*** | (2006.01) |

(52) U.S. Cl.

CPC ..... *H01Q 1/243* (2013.01); *H01Q 1/38* (2013.01); *H01Q 1/48* (2013.01); *H01Q 5/10* (2015.01); *H01Q 7/00* (2013.01); *H01Q 9/42* (2013.01); *H01Q 13/08* (2013.01)

(58) Field of Classification Search

CPC ..... H01Q 9/42; H01Q 1/48; H01Q 1/243; H01Q 9/265; H01Q 1/521

See application file for complete search history.

(56) References Cited

U.S. PATENT DOCUMENTS

| | | | | |
|---|---|---|---|---|
| 2008/0211725 | A1* | 9/2008 | Ollikainen | H01Q 1/243 343/749 |
| 2014/0085158 | A1* | 3/2014 | Wong | H01Q 1/48 343/841 |
| 2016/0197403 | A1* | 7/2016 | Choi | H01Q 1/38 343/700 MS |
| 2019/0081394 | A1* | 3/2019 | Edwards | H04M 1/02 |
| 2019/0198975 | A1* | 6/2019 | Chen | H01Q 1/48 |

FOREIGN PATENT DOCUMENTS

| | | |
|---|---|---|
| JP | 2004-056665 A | 2/2004 |
| JP | 2010-087752 A | 4/2010 |
| JP | 2016-225846 A | 12/2016 |

* cited by examiner

*Primary Examiner* — Ricardo I Magallanes

(74) *Attorney, Agent, or Firm* — ArentFox Schiff LLP

(57) ABSTRACT

An antenna device includes a ground plane that includes an edge and a surface, a protruding metallic member that includes a first connecting part and a second connecting part coupled to the ground plane, protrudes from the edge, and constructs a first loop including the edge, and a T-shaped antenna element that extends from a feeding point to a first end and a second end along the edge, the feeding point being disposed in the vicinity of the surface between the first connecting part and the second connecting part of the first loop, wherein a length of the first loop corresponds to an electric length of one wavelength in a first frequency, and corresponds to an electric length of two wavelengths in a second frequency that is a second order harmonic of the first frequency.

3 Claims, 34 Drawing Sheets

3.5GHz

5GHz 2.45GHz 3.5GHz 5.5GHz 2.45GHz 3.5GHz 5.5GHz 4.9GHz 2.5GHz

ANTENNA DEVICE

CROSS-REFERENCE TO RELATED APPLICATION

This application is based upon and claims the benefit of priority of the prior Japanese Patent Application No. 2018-89427, filed on May 7, 2018, the entire contents of which are incorporated herein by reference.

FIELD

The embodiments discussed herein are related to an antenna device.

BACKGROUND

Conventionally, there is an antenna device including a feed element to which a high frequency current is fed, and a looped parasitic element disposed apart a predetermined space from the feed element.

Incidentally, the conventional antenna device communicates in a single frequency band and may not communicate in a plurality of frequency bands.

The following is a reference document. [Document 1] Japanese Laid-open Patent Publication No. 2004-056665.

SUMMARY

According to an aspect of the embodiments, an antenna device includes a ground plane that includes an edge and a surface, a protruding metallic member that includes a first connecting part and a second connecting part coupled to the ground plane, protrudes from the edge, and constructs a first loop including the edge, and a T-shaped antenna element that extends from a feeding point to a first end and a second end along the edge, the feeding point being disposed in the vicinity of the surface between the first connecting part and the second connecting part of the first loop, wherein a length of the first loop corresponds to an electric length of one wavelength in a first frequency, and corresponds to an electric length of two wavelengths in a second frequency that is a second order harmonic of the first frequency, and a length from the feeding point of the T-shaped antenna element to the first end or the second end corresponds to an electric length of a quarter wavelength in a third frequency.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

In the following, description is given of embodiments to which the antenna device of the present disclosure is applied.

Embodiment 1

Figure 1:
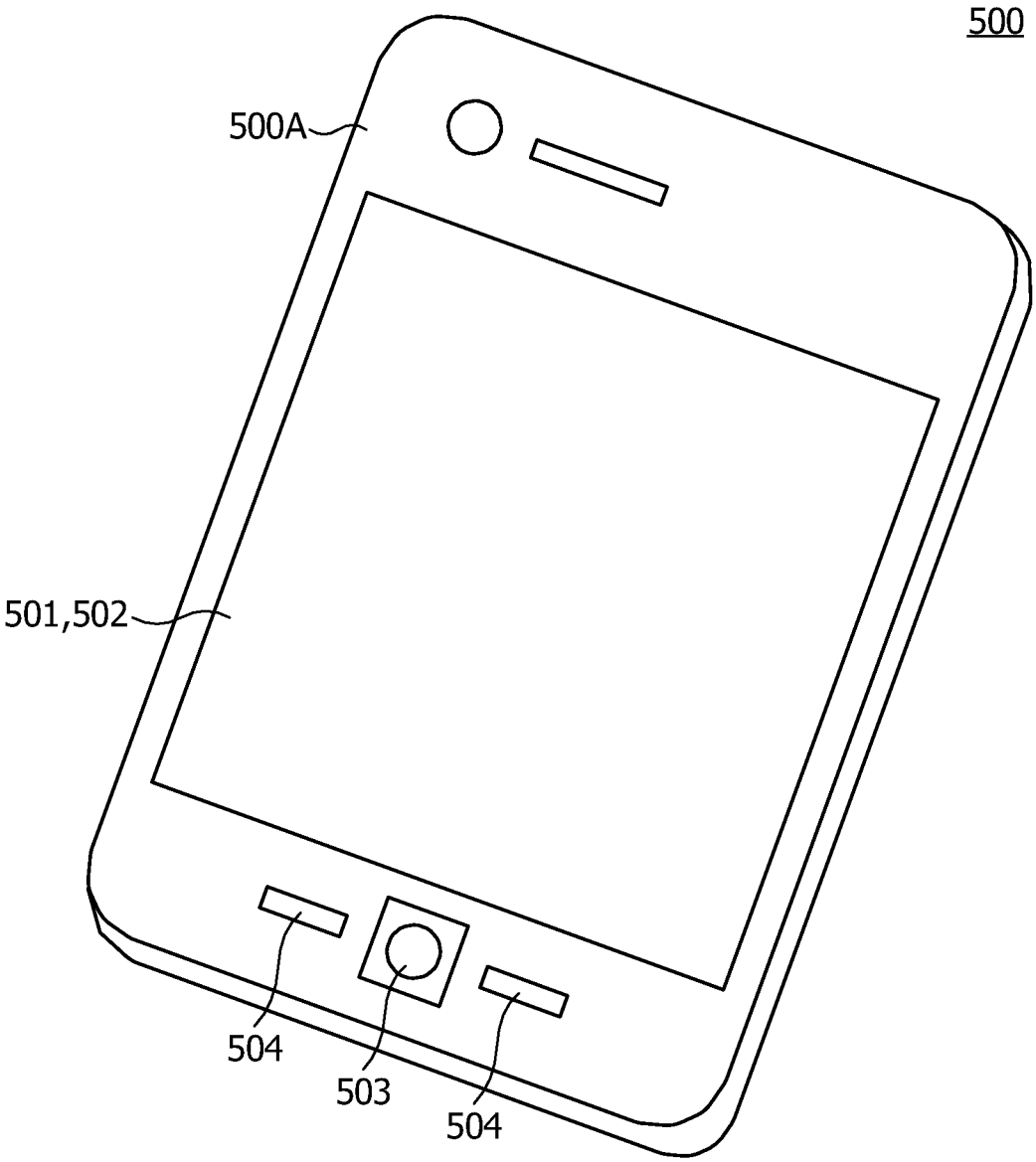
FIG. 1 is a perspective view of a front side of a tablet computer including an antenna device of an embodiment 1.

FIG. 1 is a perspective view of a front side of a tablet computer 500 including an antenna device of an embodiment 1. The tablet computer 500 is an example of electronic equipment including the antenna device of the embodiment 1.

The electronic equipment including the antenna device of the embodiment 1 is not limited to the tablet computer 500 and may be a smart phone terminal. In addition, the electronic equipment is not limited to the tablet computer and the smart phone terminal, and may be a sensor used for Internet of things (IoT) or may be a wireless relay.

If the electronic equipment is the sensor used for IoT, the sensor may be a sensor that monitors behavior of a worker and transmits acquired data to a server by wireless communications. In addition, if the electronic equipment is the wireless relay, the wireless relay may be a wireless relay that receives data from a base station which builds a mobile phone network, for example, transmits the data to a computer having a communication capability via a wireless local area network (LAN), and performs actions opposite to this. In addition, the electronic equipment including the antenna device of the embodiment 1 may be equipment utilized for any use other than the foregoing.

In a housing 500A of the tablet computer 500, a touch panel 501 and a display panel 502 are disposed on a front side, and a home button 503 and a switch 504 are disposed on a lower side of the touch panel 501. The touch panel 501 is located on a front face side of the display panel 502.

Note that the electronic equipment including the antenna device of the embodiment 1 is not limited to the tablet computer 500 and may be the smart phone terminal, a mobile phone terminal, or a game console, or the like.

Figure 2:
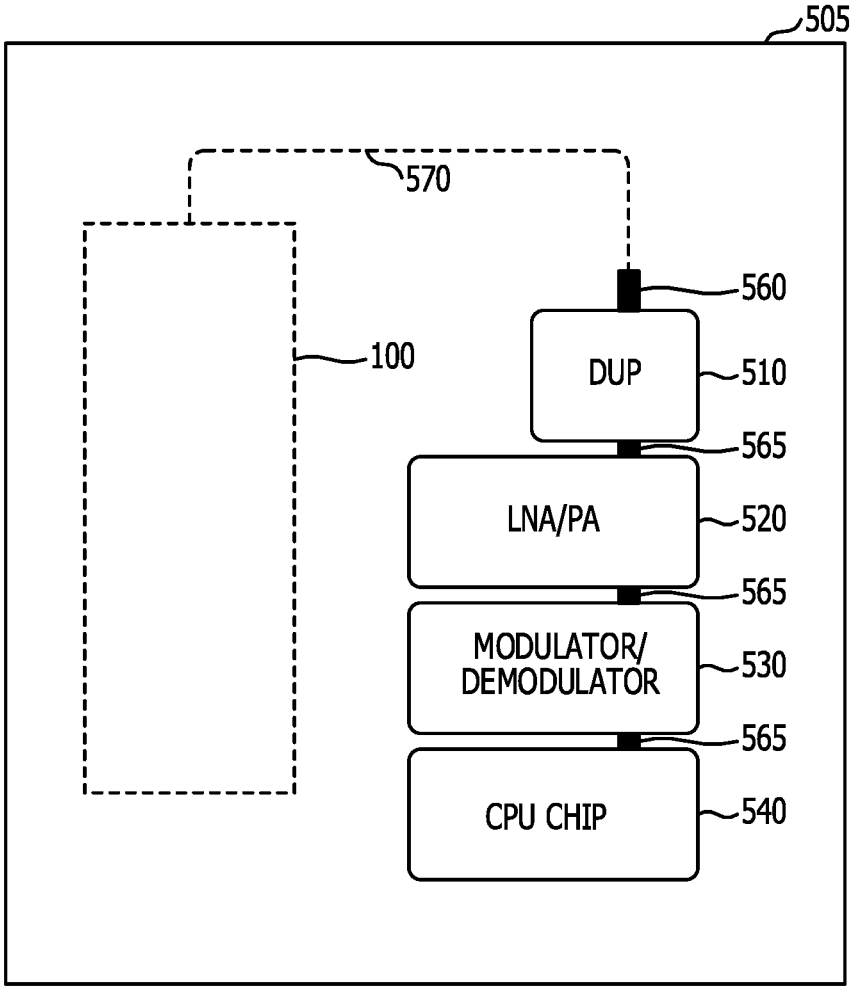
FIG. 2 is a diagram illustrating a wiring board of the tablet computer.

FIG. 2 is a diagram illustrating a wiring board 505 of the tablet computer 500.

The wiring board 505 is disposed within the housing 500A (see FIG. 1). To the wiring board 505 are mounted a duplexer (DUP) 510, a lower noise amplifier (LNA)/power amplifier (PA) 520, a modulator/demodulator 530, and a central processing unit (CPU) chip 540.

In addition, the antenna device 100 of the embodiment 1 is disposed on a surface opposite to the face of the wiring board 505 where the DUP 510, the LNA/PA 520, the modulator/demodulator 530, and the CPU chip 540 are mounted. In FIG. 2, a position of the antenna device 100 is depicted in a dashed line, as a detailed configuration of the antenna device 100 is described below.

The DUP 510, the LNA/PA 520, the modulator/demodulator 530, and the CPU chip 540 are connected via a wire 565.

The DUP 510 is connected to an antenna element of the antenna device 100 via a coaxial cable 570 installed on side opposite to the wiring board 505 through an unillustrated via from the wire 560, and switches transmission or reception. The DUP 510 has a capability as a filter. Thus, when the antenna device 100 receives signals having a plurality of frequencies, the DUP 510 may internally separate the signals of the respective frequencies.

The LNA/PA 520 amplifies power of a transmission wave and a receiving wave. The modulator/demodulator 530 modulates the transmission wave and demodulates the receiving wave. The CPU chip 540 has a capability as a communication processor that performs communication processing of the tablet computer 500 and a capability as an application processor that executes an application program. Note that the CPU chip 540 has an internal memory to store data to transmit or the received data or the like.

Note that the wires 560 and 565 are formed by patterning copper foil of a front face of the wiring board 505, for example. In addition, although illustration is omitted in FIG. 2, a matching circuit for adjusting impedance characteristics is placed between the antenna device 100 and the DUP 510.

Figure 3:
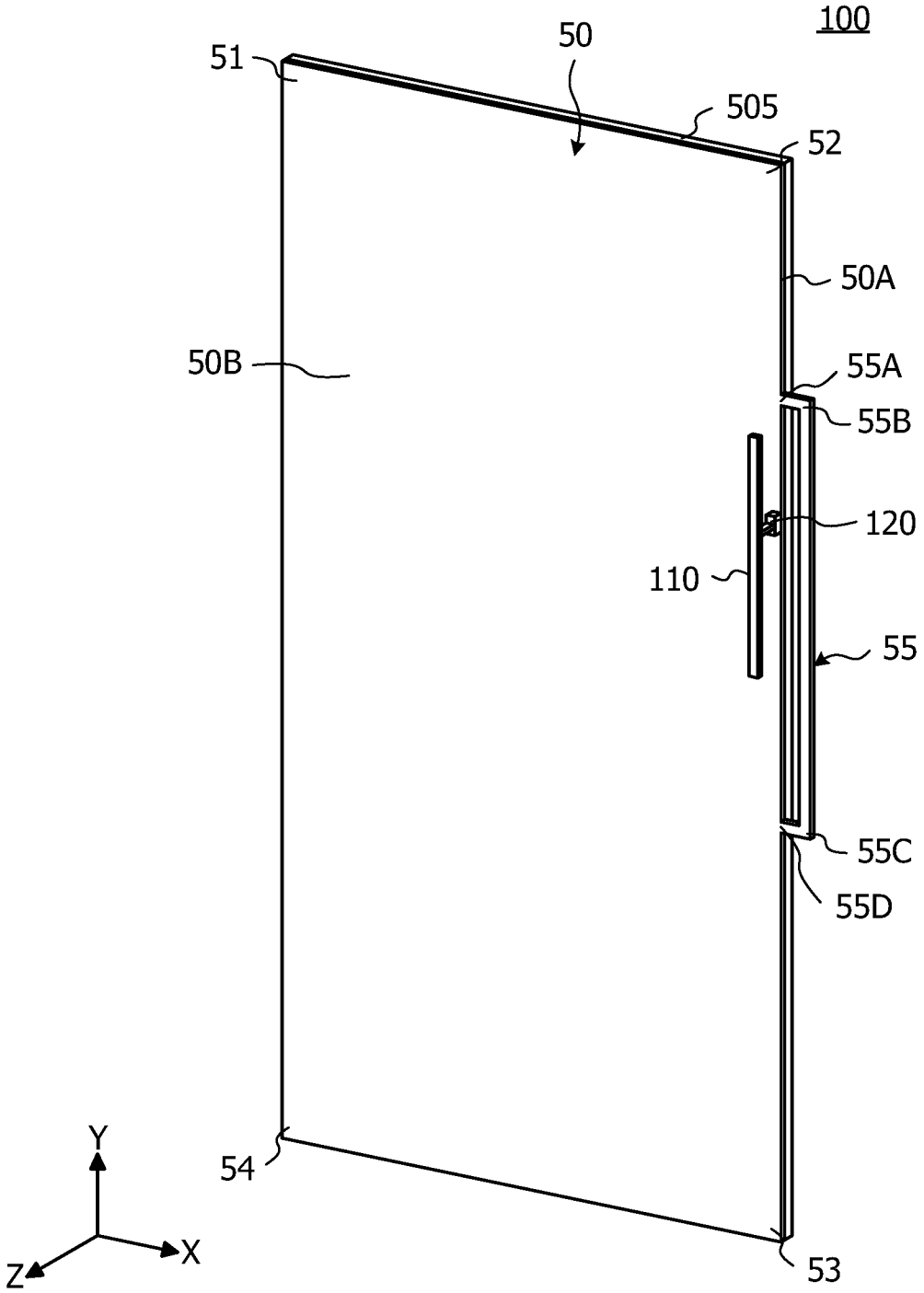
FIG. 3 is a perspective view of an antenna device of the embodiment 1.
Figure 4:
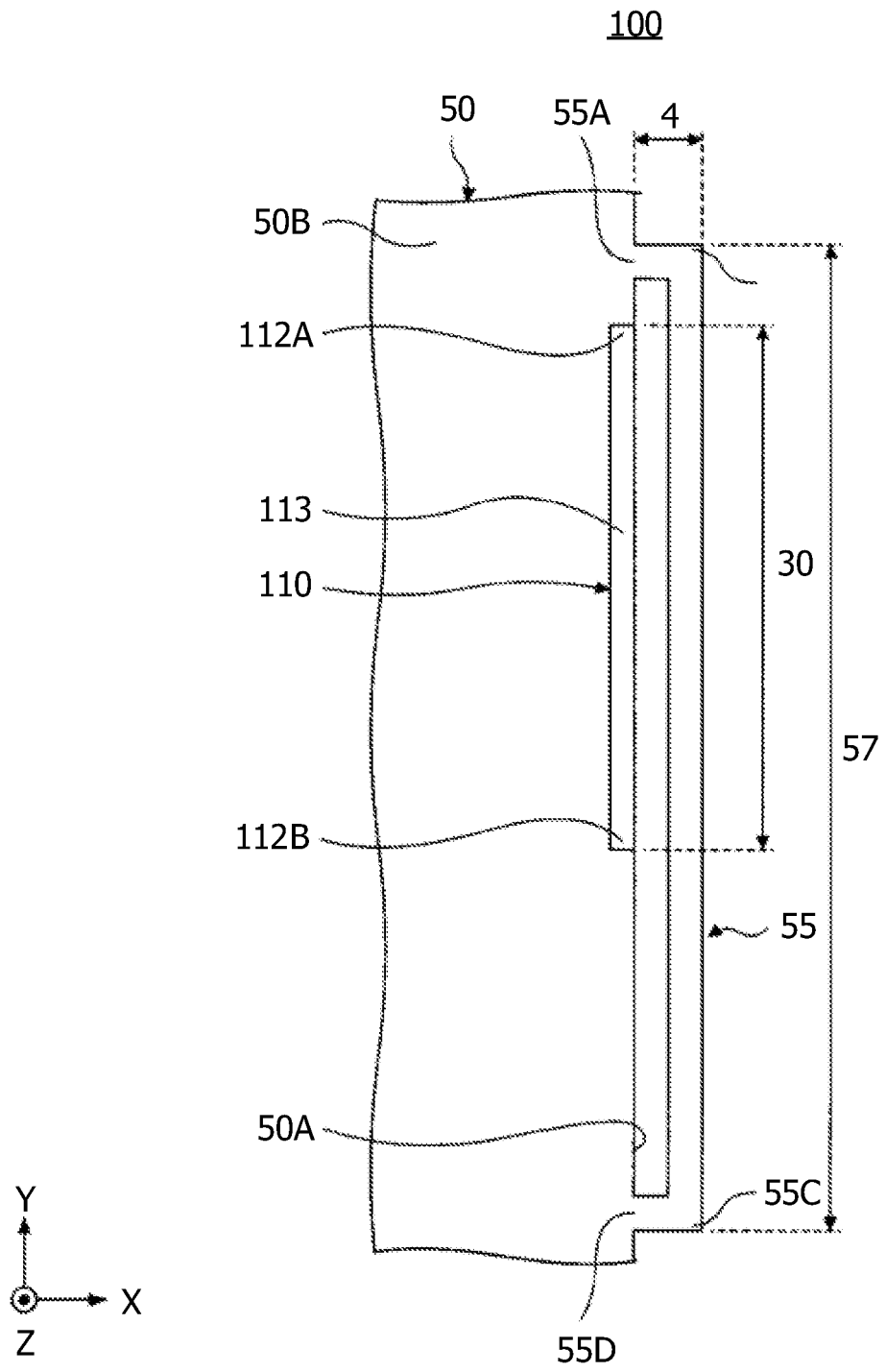
FIG. 4 is a top view enlarging a portion of FIG. 3.
Figure 5:
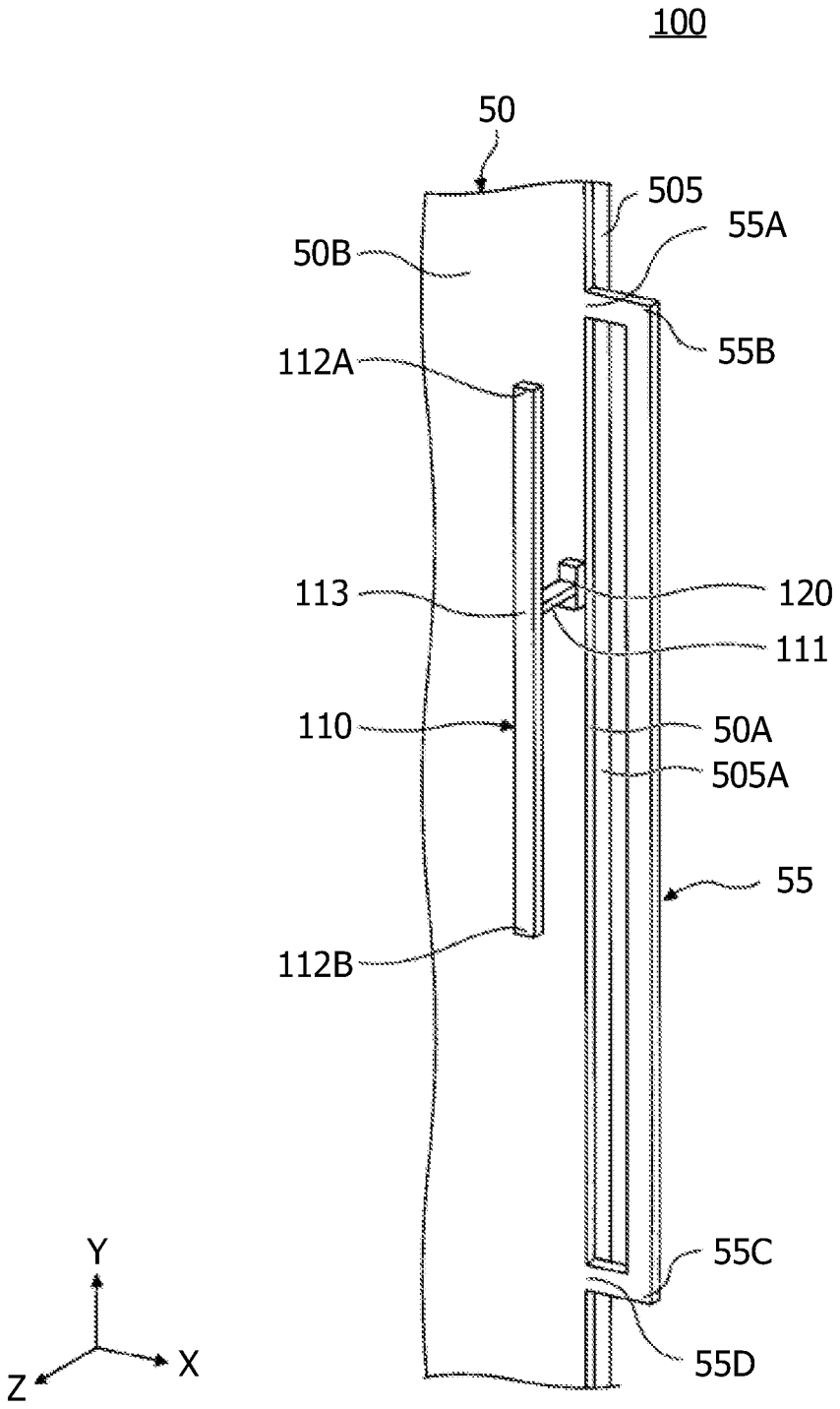
FIG. 5 is a perspective view enlarging the portion of FIG. 3.
Figure 6:
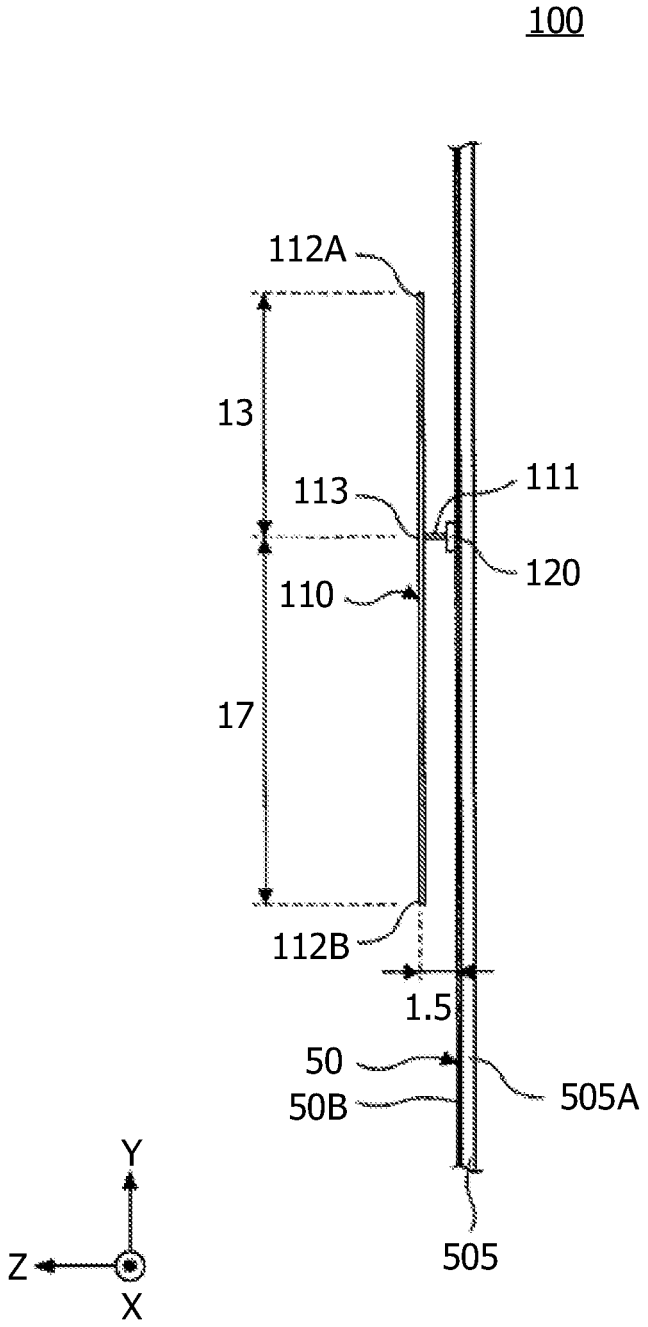
FIG. 6 is a view of a side surface of the portion enlarged in FIGS. 4 and 5.
Figure 7:
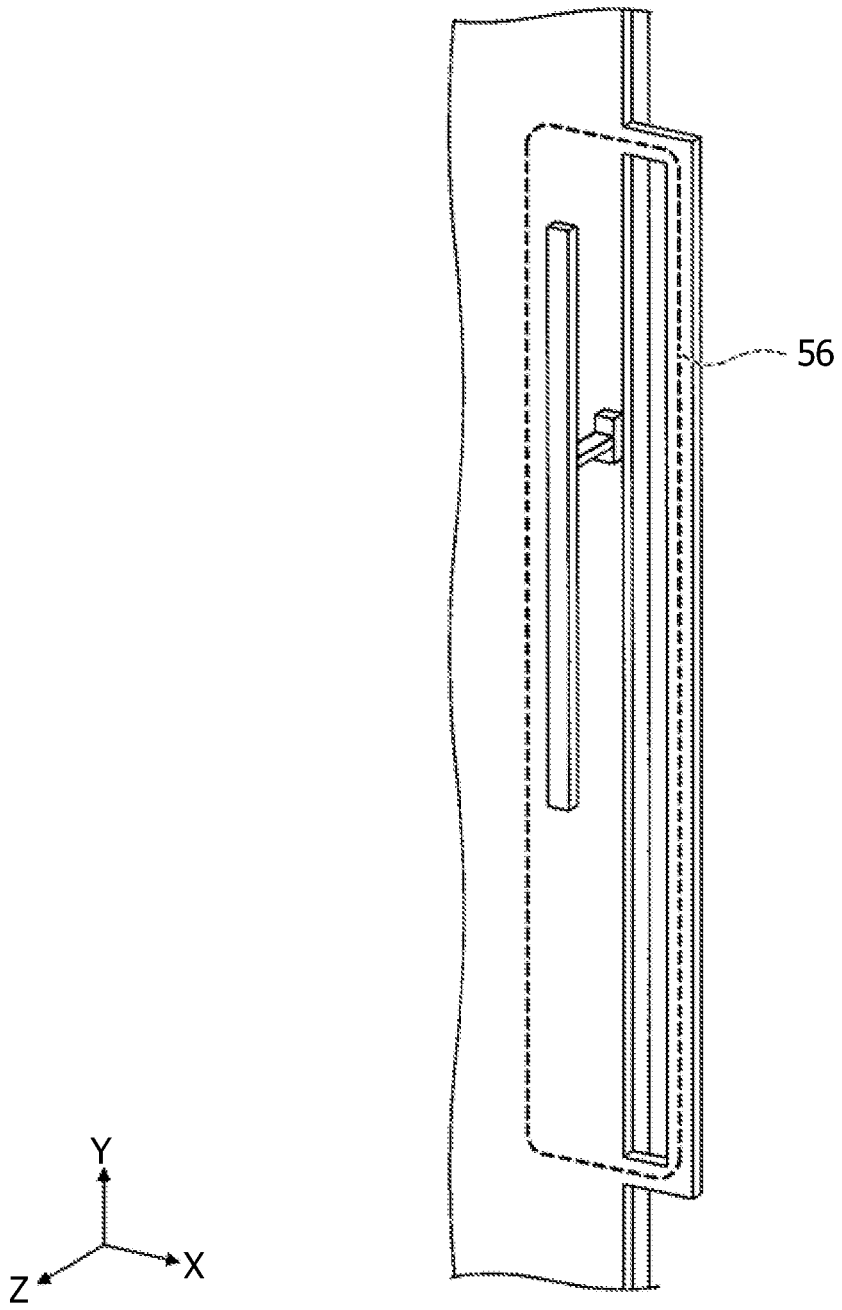
FIG. 7 is a diagram illustrating a loop of a current pathway in the antenna device.

FIG. 3 is a perspective view of the antenna device 100 of the embodiment 1. FIG. 4 is a top view enlarging a portion of FIG. 3. FIG. 5 is a perspective view enlarging the portion of FIG. 3. FIG. 6 is a view of a side surface of the part enlarged in FIGS. 4 and 5. FIG. 7 is a diagram illustrating a loop of a current pathway in the antenna device 100. FIG. 7 illustrates portions corresponding to FIG. 5, and omits any symbols other than the symbol representing the loop.

The antenna device 100 includes a wiring board 505, a ground plane 50, a frame part 55, an antenna element 110, and a matching circuit 120. The antenna device 100 is placed in the tablet computer 500 (see FIG. 1) having the communication capability.

By way of example, the antenna device 100 communicates in three frequency bands: 2.45 GHz band and 5 GHz band for a wireless local area network (WLAN), and 3.5 GHz. In the following, the 2.45 GHz is referred to as an f1 band, the 5 GHz an f2 band, and the 3.5 GHz an f3 band. A frequency included in the 2.45 GHz band is an example of a first frequency, a frequency included in the 5 GHz band is an example of a second frequency, and a frequency included in the 3.5 GHz band is an example of a third frequency.

Note that the 2.45 GHz band is a band including frequencies around the 2.45 GHz assigned for the WLAN, and the 5 GHz band is a band including frequencies around 5 GHz assigned for the WLAN. In addition, the 3.5 GHz band is a band including frequencies around 3.5 GHz assigned to a fourth-generation mobile communication system.

The ground plane 50 is a metal layer held to a ground potential. The ground plane 50 is a rectangular metal layer with apexes 51, 52, 53, and 54, and implemented by a metal layer like a thin film such as copper foil, or the like. The ground plane 50 may be treated as an earth plate or a bottom board.

The ground plane 50 is a metal layer disposed on the wiring board 505 of flame-retardant type 4 (FR-4) standard, for example. Here, by way of example, the ground plane 50 is placed on a surface (surface on side of a Z axis positive direction) on side opposite to the surface where the DUP 510, the LNA/PA 520, the modulator/demodulator 530, the CPU chip 540, and the wires 560 and 565 of the wiring board 505 are disposed, but may be a metal layer placed in an inner layer of the wiring board 505.

Although FIG. 1 illustrates the ground plane 50 where sections between the apexes 51 and 52, between the apexes 53 and 54 and between the apexes 54 and 51 are respectively linear edges, the edges may not be linear due to concavity and convexity formed in accordance with an internal shape or the like of the housing of the electronic equipment including the antenna device 100, for example. Note that a side between the apexes 52 and 53 of the ground plane 50 is referred to as an edge 50A. The edge 50A is located at a position that matches, in planar view, an edge 505A extending to a Y axis direction on side of an X axis positive direction of the wiring board 505.

In addition, the antenna element 110 is placed on the side of the Z axis positive direction of a surface 50B of the ground plane 50 and the frame part 55 is connected to the edge 50A. Note that the frame part 55 is omitted in FIG. 6.

The frame part 55 is placed to protrude from the edge 50A of the ground plane 50 to the X axis positive direction side. The frame part 55 is a frame-like metallic member protruding from the edge 50A of the ground plane 50 to the X axis positive direction side. The frame part 55 has a connecting end 55A, bending parts 55B and 55C, and a connecting end 55D. The frame part 55 is held to the ground potential, similarly to the ground plane 50.

The frame part 55 is connected to the edge 50A by the connecting end 55A and extends from the connecting end 55A to the bending part 55B on the X axis positive direction side; is bent to Y axis negative direction side at the bending part 55B and extends from the bending part 55B to the bending part 55C; is bent to X axis negative direction side at the bending part 55C and extends from the bending part 55C to the connecting end 55D. The connecting end 55D is connected to the edge 50A.

The frame part 55 is an example of the protruding metallic member. The connecting end 55A is an example of a first connecting part. The bending parts 55B and 55C are respectively examples of a first bending part and a second bending part. The connecting end 55D is an example of a second connecting part. In addition, a section between the connecting end 55A and the bending part 55B is an example of a first section. A section between the bending parts 55B and 55C is an example of a second section. A section between the bending part 55C and the connecting end 55D is an example of a third section.

In addition, a rectangular loop formed by the edge 50A coupling with the antenna element 110 as a parasitic element, the frame part 55 integrally operates. The loop formed by the frame part 55 and the edge 50A is an example of a first loop.

The loop (example of the first loop) constructed by a section between the connecting ends 55A and 55D of the edge 50A and by the frame part 55 is hereinafter referred to as a parasitic loop 56 (see FIG. 7). A length of the parasitic loop 56 is set to an electric length of one wavelength in the f1 band and set to the electric length of two wavelengths in the f2 band that is a second order harmonic of the f1 band.

The antenna element 110 has a feeding point 111, and ends 112A and 112B, and is placed in the vicinity of the surface 50B of the ground plane 50 via the matching circuit 120. The antenna element 110 is embodied by a metal layer such as filmy and linear copper foil. The ends 112A and 112B are respectively examples of a first end and a second end.

The antenna element 110 extends from the feeding point 111 to a branching point 113 in the Z axis positive direction, and extends from the branching point 113 to each of the ends 112A and 112B in a Y axis positive direction and the Y axis negative direction. Such an antenna element 110 is fixed to an inner surface of the housing 500A (see FIG. 1), for example.

The antenna element 110 is a T-shaped antenna element, and spacing to the surface 50B (height to the surface 50B) of the ground plane 50 of a section between the ends 112A and 112B is fixed. In addition, a line width (width in the X axis direction) of a line between the feeding point 111 and the branching point 113, the line width of a line between the branching point 113 and the end 112A, and the line width of a line between the branching point 113 and the end 112B are all equal.

A length of the antenna element 110 from the feeding point 111 to the end 112B through the branching point 113 is set to ¼ of the electric length (λ) of a wavelength in the f3 band, including wavelength shortening effect by the matching circuit 120.

Note that a length from the feeding point 111 to the end 112A through the branching point 113 is shorter than the length from the feeding point 111 to the end 112B through the branching point 113. This is because the branching point 113 is located at a position that is offset to the Y axis positive direction side than to a midpoint of the ends 112A and 112B.

At a position abutting on the edge 50A in the section between the connecting ends 55A and 55D of the frame part 55, the feeding point 111 is spaced from the surface 50B of the ground plane 50 and is placed in the vicinity of the surface 50B.

To the feeding point 111 is connected a core wire of the coaxial cable 570 via the matching circuit 120. A shield wire of the coaxial cable 570 is connected to the ground plane 50 in the vicinity of the feeding point 111. The feeding point 111 is connected to the core wire of the coaxial cable 570 (see FIG. 2) via the matching circuit 120 and receives power.

In the antenna device 100, power is fed to the parasitic loop 56 via the antenna element 110. Thus, in order to place the antenna element 110 to the parasitic loop 56 as close as possible, the matching circuit 120 is disposed at a position abutting on the edge 50A, so that the edge on the X axis positive direction side of the line between the ends 112A and 112B matches the edge 50A in planar view.

The matching circuit 120 is connected between the feeding point 111, the core wire of the coaxial cable 570, and the ground plane 50. The matching circuit 120 has an inductor and/or a condenser and is placed to match impedance between the feeding point 111, the core wire of the coaxial cable 570, and the ground plane 50.

The matching circuit 120 branches from the section between the feeding point 111 and the core wire of the coaxial cable 570 and is placed in a section to the ground plane 50. The matching circuit 120 adjusts impedance of the f3 band and has a characteristic that the matching circuit 120 seems open (opening/high impedance (Hi-Z)) to the f1 band and the f2 band.

Note that by way of example, dimensions of the respective parts are as follows. The dimensions illustrated here are based on an assumption that communications in the f3 band (3.5 GHz band) are performed with the antenna element 110 and the communications in the f1 band (2.45 GHz band) and the f2 band (5 GHz band) are performed with the parasitic loop.

As illustrated in FIG. 4, a length between the connecting ends 55A and 55D of the frame part 55 in the Y axis direction is 57 mm. The length between the connecting ends 55A and 55D in the Y axis direction is equal to a length between the bending parts 55B and 55C. In addition, a length between the connecting end 55A and the bending part 55B is 4 mm and equal to a length between the bending part 55C and the connecting end 55D.

Thus, a loop length of the parasitic loop 56 is 122 mm. The length is the electric length of one wavelength in the f1 band and the electric length of two wavelengths in the f2 band. Note that although unillustrated in FIG. 4, a width of the frame part 55 (width seen on an XY plane) is 2 mm.

In addition, as illustrated in FIGS. 4 and 5, a length between the ends 112A and 112B of the antenna element 110 is 30 mm, a length between the branching point 113 and the end 112A is 13 mm, and a length between the branching point 113 and the end 112B is 17 mm. In addition, a height (distance in the Z axis direction) to the surface 50B of the ground plane 50 in the section between the ends 112A and 112B is 1.5 mm. In addition, although unillustrated in FIGS. 4 and 5, the line width of the antenna element 110 (width of the linear metal layer) is 1 mm.

Figure 8:
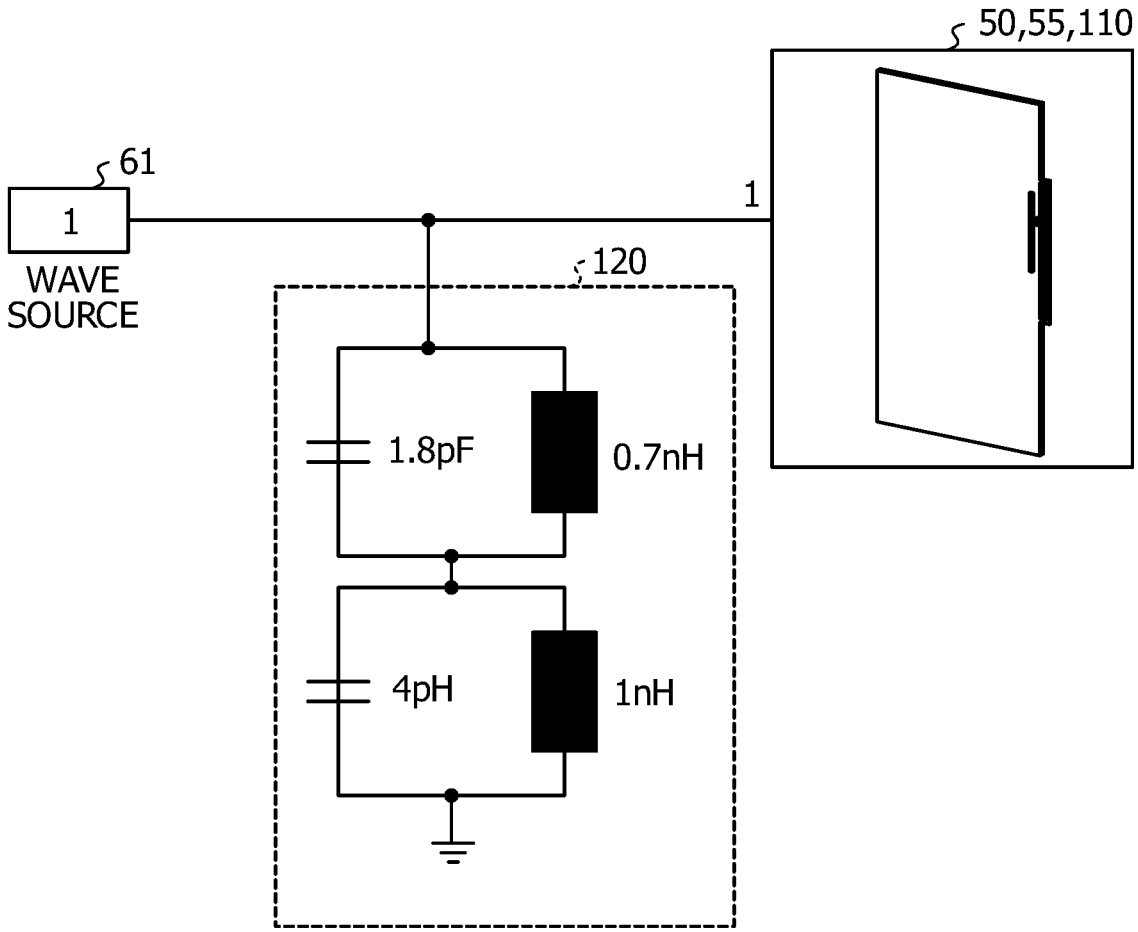
FIG. 8 is a diagram illustrating each parameter of a simulation model of the antenna device.

FIG. 8 is a diagram illustrating each parameter of a simulation model of the antenna device 100. In FIG. 8, the ground plane 50, the frame part 55, and the antenna element 110 are simplified and illustrated as a block. A port 1 is the feeding point 111. FIG. 8 also illustrates the condenser and the inductor of the matching circuit 120. In addition, a wave source 61 is a high frequency source that supplies high frequency power to the feeding point 111 (port 1) and internal impedance is 50Ω.

In addition, the simulation model conditions that the ground plane 50 infinitely extends to the directions of three sides (X axis negative direction, Y axis positive direction, and Y axis negative direction) excluding the edge 50A. In addition, a conductor such as the ground plane 50, the antenna element 110, or the like shall be a perfect conductor.

The matching circuit 120 is placed, branching from the line between the feeding point 111 and the wave source 61, and has a circuit configuration that a parallel circuit of the condenser (1.8 pF) and inductance (0.7 nH) is serially connected with a parallel circuit of the condenser (4 pF) and the inductance (1 nH).

Figure 9A:
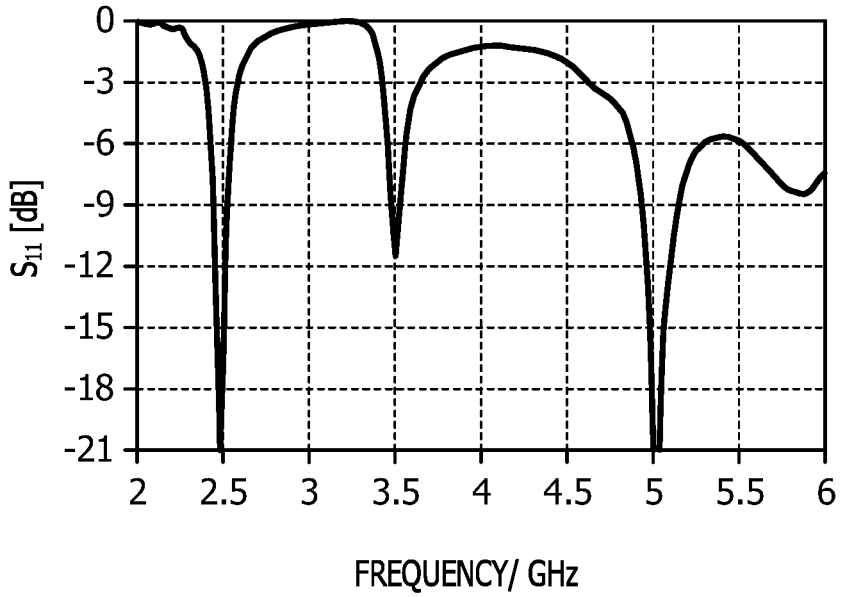
FIGS. 9A and 9B are diagrams illustrating frequency characteristics of a parameter and a total efficiency of the antenna device obtained in the simulation model illustrated in FIG. 8.
Figure 9B:
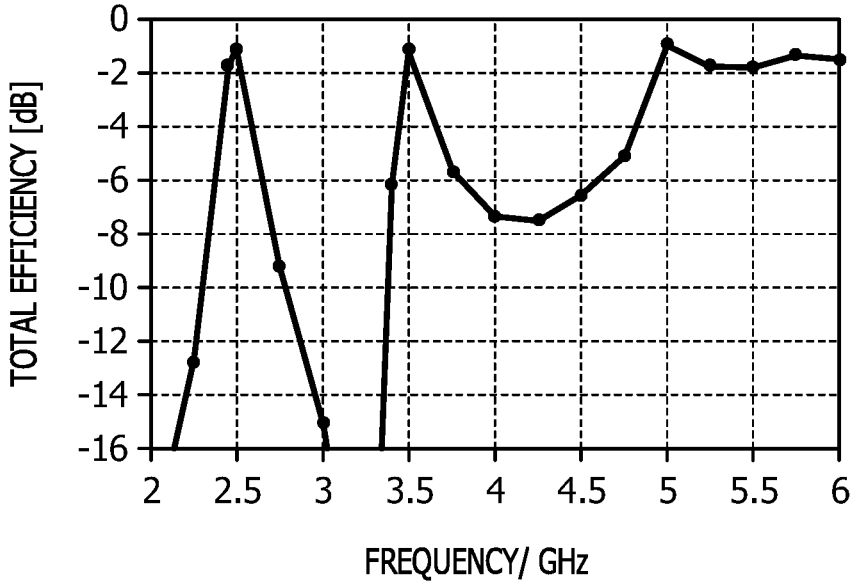

FIGS. 9A and 9B are diagrams illustrating frequency characteristics of an $S_{11}$ parameter and a total efficiency of the antenna device 100 obtained in the simulation model illustrated in FIG. 8.

In FIG. 9A, a horizontal axis represents a frequency and a vertical axis represents a value of the $S_{11}$ parameter. As illustrated in FIG. 9A, the $S_{11}$ parameter of the antenna device 100 of the simulation model is approximately −21 dB or lower at 2.45 GHz, approximately −11 dB at 3.5 GHz, and approximately −21 dB or lower at 5 GHz.

Around the three frequencies, a band where the $S_{11}$ parameter value is low to some extent is obtained. Thus, it is possible to confirm that communications are enabled in the three bands of the f1 band (2.45 GHz band), the f2 band (5 GHz band), and the f3 band (3.5 GHz band).

In addition, as illustrated in FIG. 9B, for the total efficiency, a good value of approximately −1 dB is obtained in any of 2.45 GHz, 5 GHz, or 3.5 GHz. Thus, also around the three frequencies, a band where the total efficiency is high to some extent is obtained.

Figure 10C:
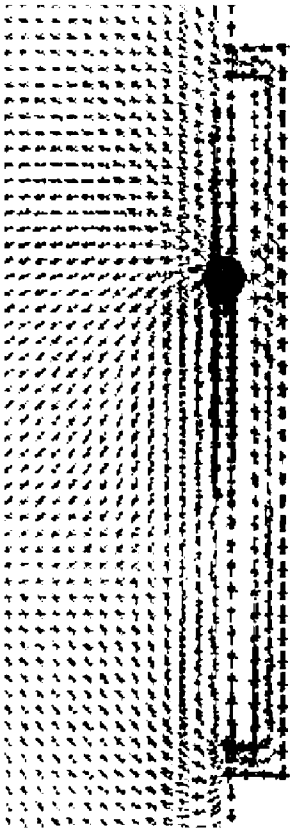
FIGS. 10A to 10C are diagrams illustrating a current distribution of a ground plane, a frame part, a parasitic loop, and an antenna element.
Figure 10B:
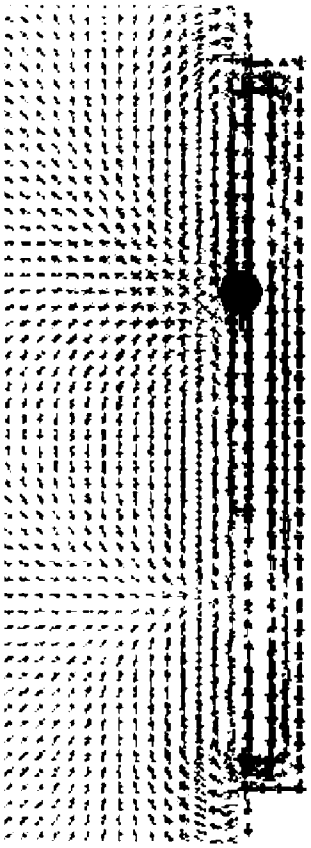
Figure 10A:
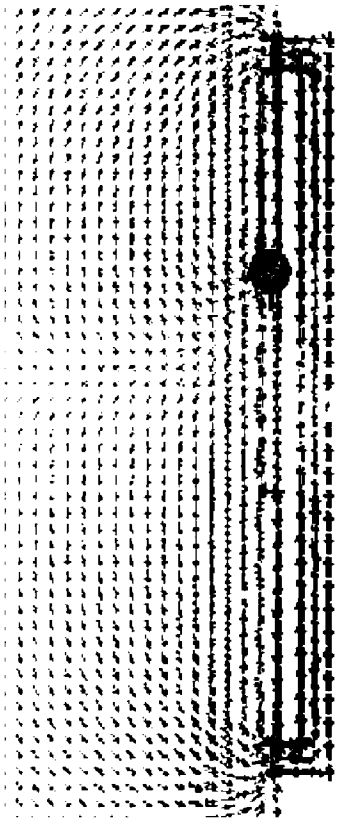

FIGS. 10A to 10C are diagrams illustrating a current distribution of the ground plane 50, the frame part 55, the parasitic loop 56, and the antenna element 110. The current distribution is determined in electromagnetic field simulation under the condition that power is fed to the feeding point 111 of the antenna element 110. An arrow represents an orientation of the current. The current distribution indicates that the darker (black) the arrow is, the higher a current value is, and the lighter (white) the arrow is, the lower the current value is. Note that symbols are omitted in FIGS. 10A to 10C.

FIG. 10A illustrates the current distribution when power is fed at 2.45 GHz. As illustrated in FIG. 10A, the current value of the parasitic loop 56 is high, revealing that a current is flowing to the parasitic loop 56. Current antinodes (two antinodes in total) are generated at both of the ends (connecting end 55A and connecting end 55D) of the parasitic loop 56 in the Y axis direction, which reveals that a standing wave corresponding to one wavelength is generated in the parasitic loop 56.

The antenna element 110 is the T-shaped antenna element disposed along the edge 50A of the ground plane. Thus, power is fed to the parasitic loop 56 from a section between the branching point 113 and the end 112B included in a monopole antenna, and it is believed that power is fed to the parasitic loop 56 also from the section between the branching point 113 and the end 112A. Note that such resonance may also be confirmed around 2.45 GHz (frequency band included in the f1 band).

FIG. 10B illustrates the current distribution when power is fed at 5 GHz. As illustrated in FIG. 10B, the current value of the parasitic loop 56 s high, revealing that the current is flowing to the parasitic loop 56. The current antinodes (four antinodes in total) are generated at both ends (connecting end 55A and connecting end 55D) of the parasitic loop 56 in the Y axis direction and a middle part in the Y axis direction, which reveals that the standing wave corresponding to two wavelengths is generated in the parasitic loop 56.

In the case of 5 GHz, similarly to the case of 2.45 GHz, it is believed that power is fed to the parasitic loop 56 not only from the section between the branching point 113 and the end 112B of the antenna element 110 but also from the section between the branching point 113 and the end 112A. Note that such resonance may also be confirmed around 5 GHz (frequency band included in the f2 band).

FIG. 10C illustrates the current distribution when power is fed at 3.5 GHz. As illustrated in FIG. 10C, the current value of the section between the feeding point 111 of the antenna element 110 and the end 112B is high, revealing that the current value of the section close to the feeding point 111, in particular, is high. With this, it may be confirmed that the section from the feeding point 111 of the antenna element 110 to the end 112B through the branching point 113 functions as the monopole antenna. Note that such resonance may also be confirmed around 3.5 GHz (frequency band included in the f3 band).

As described above, according to the embodiment 1, the section between the feeding point 111 and the end 112B of the antenna element 110 functions as the monopole antenna in the f3 band. Moreover, power being fed to the parasitic loop 56 via the T-shaped antenna element 110, the parasitic loop 56 communicates in the two frequency bands of the f1 band and the f2 band, thus making it possible to provide the antenna device 100 that may communicate in the three frequency bands.

Therefore, the antenna device 100 may be provided that communicates in a plurality of frequency bands. The antenna element 110 may be used in communications of a multi-input multi-output (MIMO) format, for example.

For example, another antenna element 110 may be placed on the edge of the ground plane 50 on the X axis positive direction side (edge opposed to the edge 50A), and the antenna element that may communicate at 3.5 GHz may be placed at each of the end of the ground plane 50 on the Y axis positive direction side and the end on the Y axis negative direction side. With this, the antenna device 100 includes four antenna elements that may communicate at 3.5 GHz, thus making it possible to implement communications in a 4×4 MIMO format. Because two antenna elements disposed at the ends of the ground plane 50 on the Y axis positive direction side and the Y axis negative direction side are sufficiently away from the two antenna elements 110, it is believed that there arises no problem of coupling.

In addition, the antenna device 100 constructs the parasitic loop 56, utilizing the frame part 55 that protrudes from the ground plane 50 to the X axis positive direction. The parasitic loop 56 is an element that has no feeding point and communicates by receiving power fed from other antenna element, or the like.

Like the electronic equipment 500, if there is a restriction on a space to dispose the antenna element 110, increasing communication frequencies by utilizing the parasitic loop 56 is efficient in allocating a space within the housing 500A of the electronic equipment 500 to various components.

Note that in the above, the configuration is described in which the edge of the line between the ends 112A and 112B of the antenna element 110 on the X axis positive direction side is disposed so as to match the edge 50A in planar view. However, the edge of the line between the ends 112A and 112B of the antenna element 110 on the X axis positive direction side does not necessarily match the edge 50A. For example, if the antenna element 110 is placed on the housing 500A, there may be a case in which matching is not possible due to a structural reason or the like, or a case in which a manufacturing error leads to slight misalignment. In addition, some space may be left for any other reasons.

Figure 11:
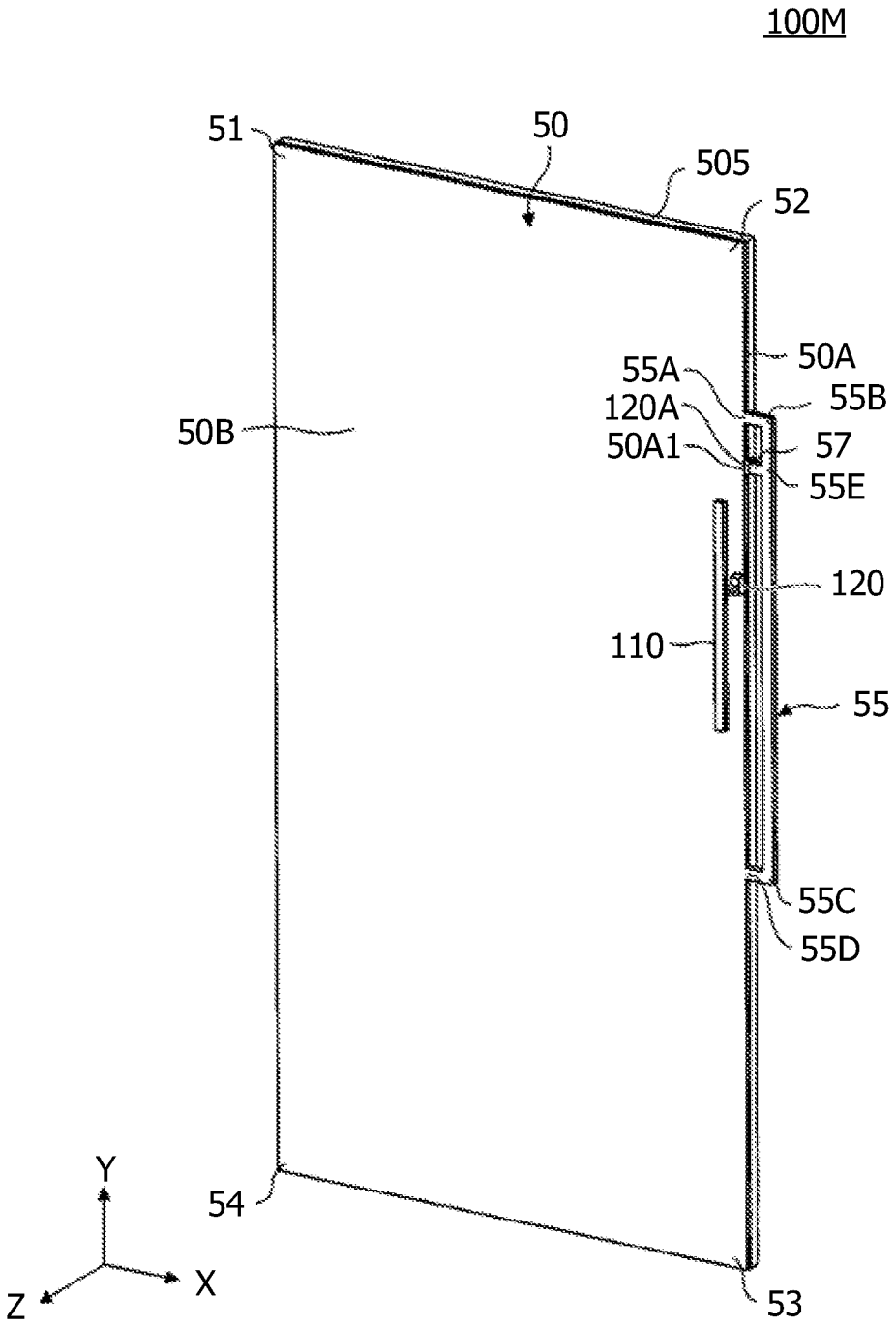
FIG. 11 is a diagram illustrating an antenna device of a modification example of the embodiment 1.
Figure 12:
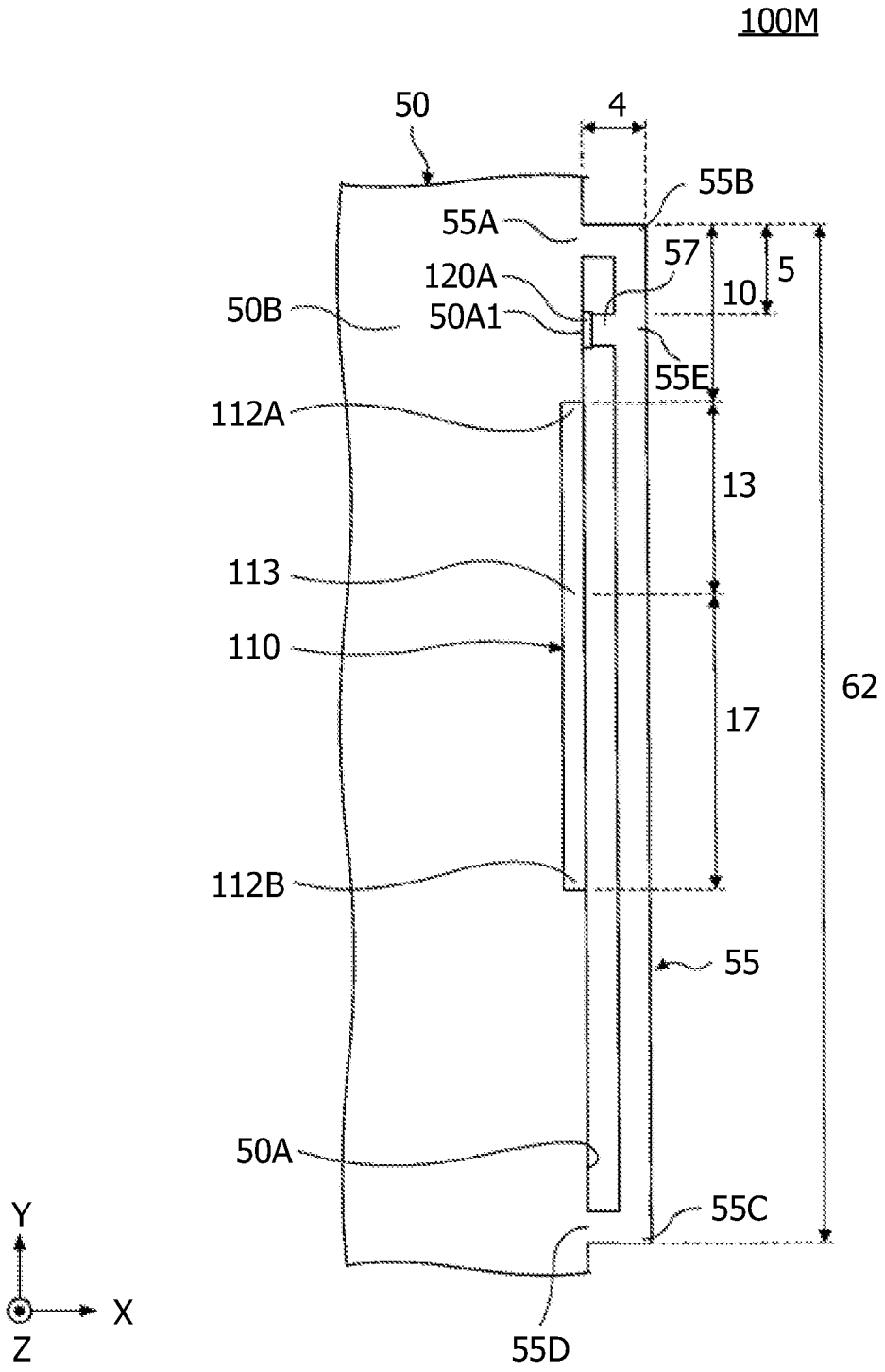
FIG. 12 is a diagram illustrating the antenna device of the modification example of the embodiment 1.
Figure 13:
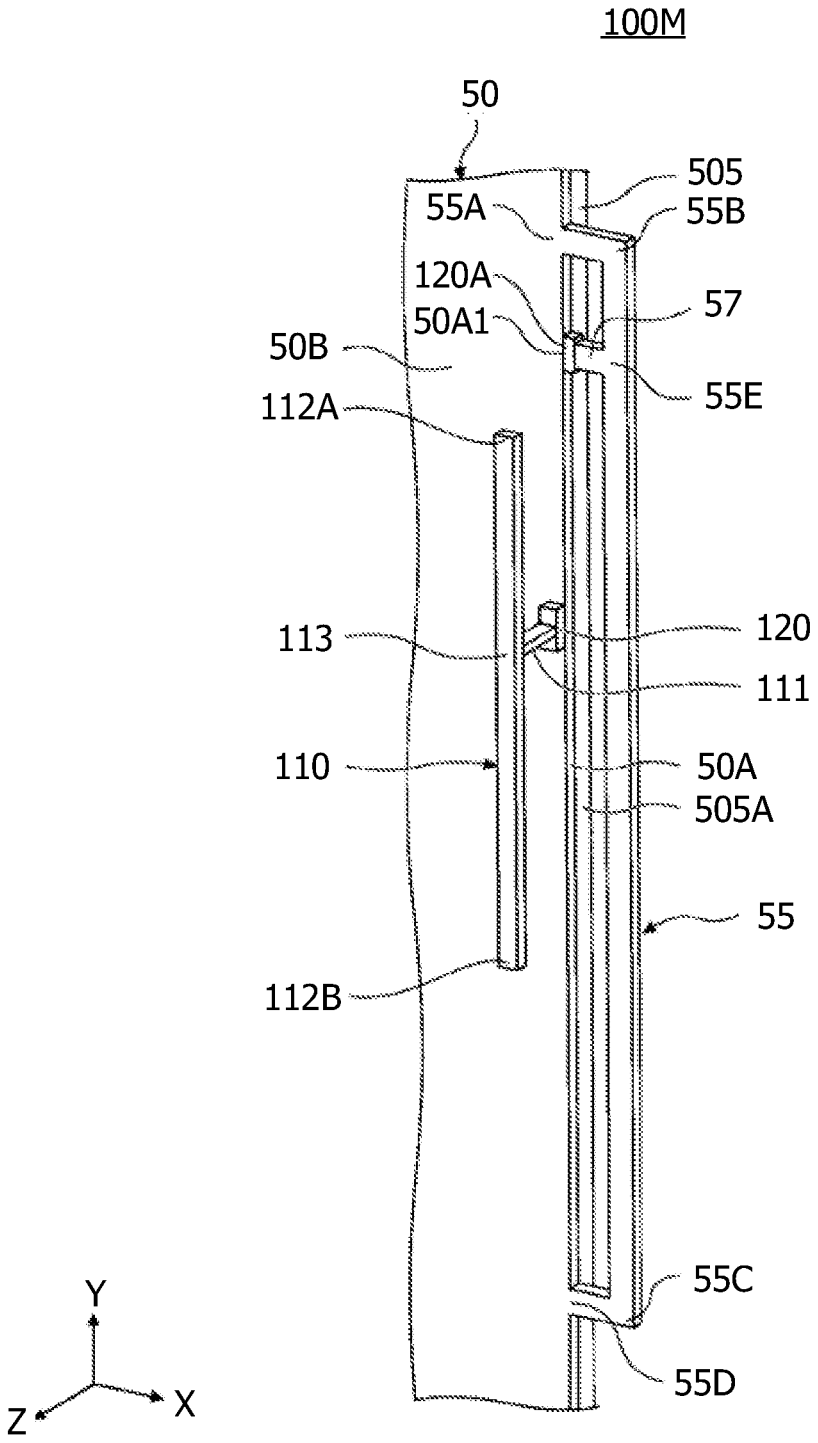
FIG. 13 is a diagram illustrating the antenna device of the modification example of the embodiment 1.

FIGS. 11 to 13 are diagrams illustrating an antenna device 100M of a modification example of the embodiment 1. The antenna device 100M is configured by adding a branching line 57 and a matching circuit 120A to the antenna device 100 illustrated in FIGS. 3 to 6. More specifically, the antenna device 100M includes the ground plane 50, the frame part 55, the branching line 57, the antenna element 110, and the matching circuits 120 and 120A.

In the antenna device 100M, the frame part 55 is a little longer to the Y axis direction, and the connecting end 55A is positioned a little closer to the Y axis positive direction side than the connecting end 55A illustrated in FIGS. 3 to 5.

The branching line 57 branches from the frame part 55 at a point 55E located at a position (position on the bending part 55B side than the midpoint of the bending parts 55B and 55C) close to the bending part 55B between the bending part 55B and the bending part 55C of the frame part 55, and extends to the edge 50A in the X axis negative direction. A tip of the branching line 57 is positioned in front of the edge 50A by a predetermined distance, and the matching circuit 120A is inserted between the tip of the branching line 57 and the edge 50A.

The matching circuit 120A is placed between the tip of the branching line 57 and the edge 50A of the ground plane 50. The matching circuit 120A is placed to adjust the electric length of the loop constructed by the branching line 57, the matching circuit 120A, a section between a point 50A1, to which the matching circuit 120A of the edge 50A of the ground plane 50 is connected, and the connecting end 55D, and a section between the connecting end 55D of the frame part 55 and the point 55E. The matching circuit 120A is a condenser to be inserted in series between the tip of the branching line 57 and the point 50A1 of the edge 50A, for example.

Here, a loop constructed by the branching line 57, the section between the point, to which the matching circuit 120A of the edge 50A of the ground plane 50 is connected, and the connecting end 55D, and the section between the connecting end 55D of the frame part 55 and the point 55E is referred to as a parasitic loop 56A (see FIG. 12).

A length of the parasitic loop 56A is set to the electric length of one wavelength in the f1 band and set to the electric length of two wavelengths in the f2 band that is a second order harmonic of the f1 band. The parasitic loop 56A is an example of a second loop.

For example, in the electronic equipment 500 including the antenna device 100, if there is a section from the connecting end 55A of the frame part 55 to the point 55E by way of the bending part 55B, addition of the branching line 57 may construct the parasitic loop 56A.

More specifically, as illustrated in FIG. 12, if the length between the connecting ends 55A and 55D of the frame part 55 in the Y axis direction is 62 mm, it is sufficient if the branching line 57 is connected to a position 5 mm away from the bending part 55B in the Y axis negative direction. This may set the length between the point 55E to which the branching line 57 is connected and the bending part 55C to 57 mm, and the parasitic loop 56A has the loop length equal to the parasitic loop 56 illustrated in FIG. 4.

Note that the length between the connecting end 55A and the end 112A in the Y axis direction is 10 mm. Similarly to FIG. 6, the length between the branching point 113 of the antenna element 110 and the end 112A is 13 mm. The length between the branching point 113 and the end 112B is 17 mm. In addition, the line width (width of the linear metal layer) of the antenna element 110M is 2 mm.

Figure 14:
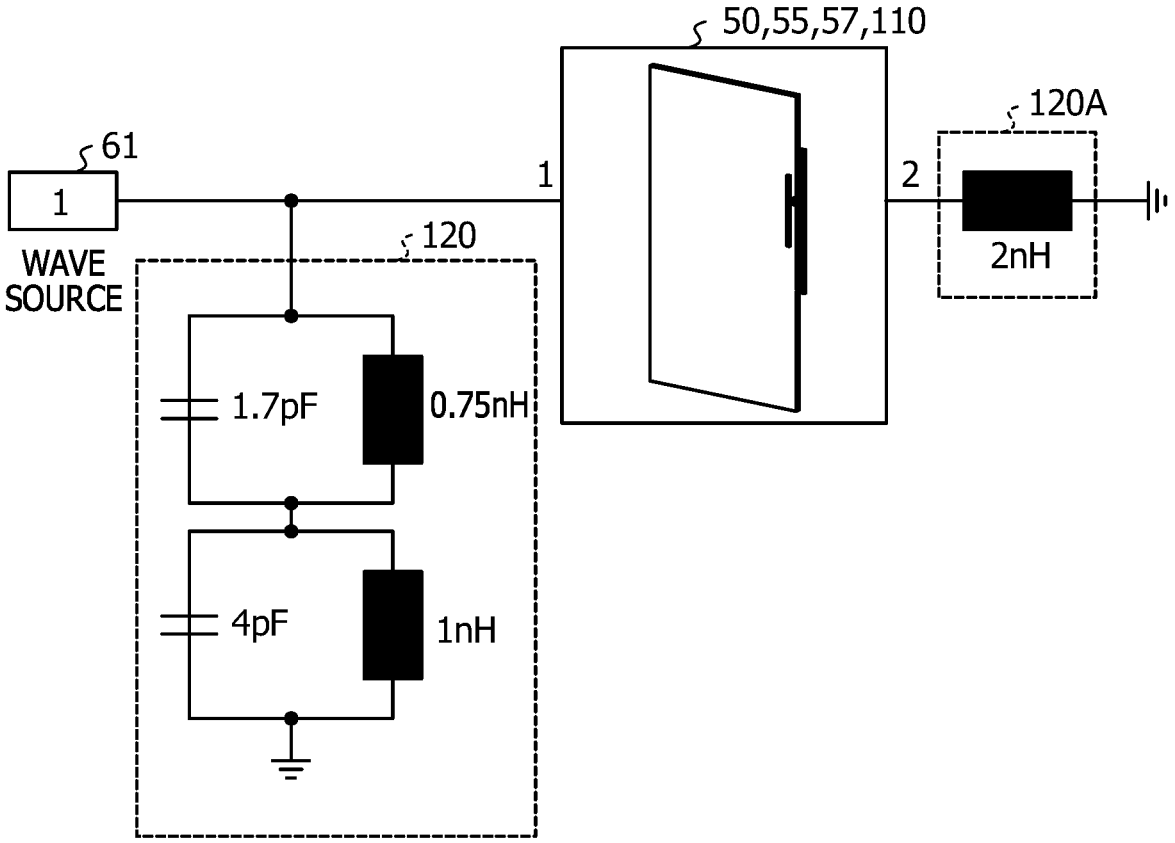
FIG. 14 is a diagram illustrating each parameter of a simulation model of the antenna device.

FIG. 14 is a diagram illustrating each parameter of a simulation model of the antenna device 100M. In FIG. 14, the ground plane 50, the frame part 55, the branching line 57, and the antenna element 110 are simplified and illustrated as a block. The port 1 is the feeding point 111 and a port 2 is the tip of the branching line 57.

In addition, the wave source 61 is a high frequency source that supplies the high frequency power to the feeding point 111 (port 1) and the internal impedance is 50Ω.

The simulation model conditions that the ground plane 50 infinitely extends to the directions of the three sides (X axis negative direction, Y axis positive direction, and Y axis negative direction) excluding the edge 50A. In addition, the conductor such as the ground plane 50, the frame part 55, the branching line 57, and the antenna element 110 shall be the perfect conductor.

The matching circuit 120 is placed, branching from the line between the feeding point 111 and the wave source 61, and has the circuit configuration that the parallel circuit of the condenser (1.7 pF) and the inductance (0.75 nH) is serially connected with the parallel circuit of the condenser (4 pF) and the inductance (1 nH). The matching circuit 120A has the inductance (5 nH) serially connected in the section to a grounding point.

As described above, in the antenna device 100M, similarly to the antenna device 100 illustrated in FIG. 3 to FIG. 6, the section between the feeding point 111 of the antenna element 110 and the end 112B functions as the monopole antenna in the f3 band. Moreover, power being fed to the parasitic loop 56A via the T-shaped antenna element 110, the parasitic loop 56A communicates in the two frequency bands of the f1 band and the f2 band. More specifically, the antenna device 100M that may communicate in the three frequency bands may be provided in the modification example of the embodiment 1.

Therefore, in the modification example of the embodiment 1, the antenna device 100M may be provided that communicates in the plurality of frequency bands.

Note that the branching line 57 may branch from the frame part 55 and extend to go to the edge 50A at a position close to the bending part 55C (position closer to the bending part 55C side than the midpoint between the bending parts 55B and 55C) between the bending part 55B and the bending part 55C of the frame part 55.

Embodiment 2

Figure 15:
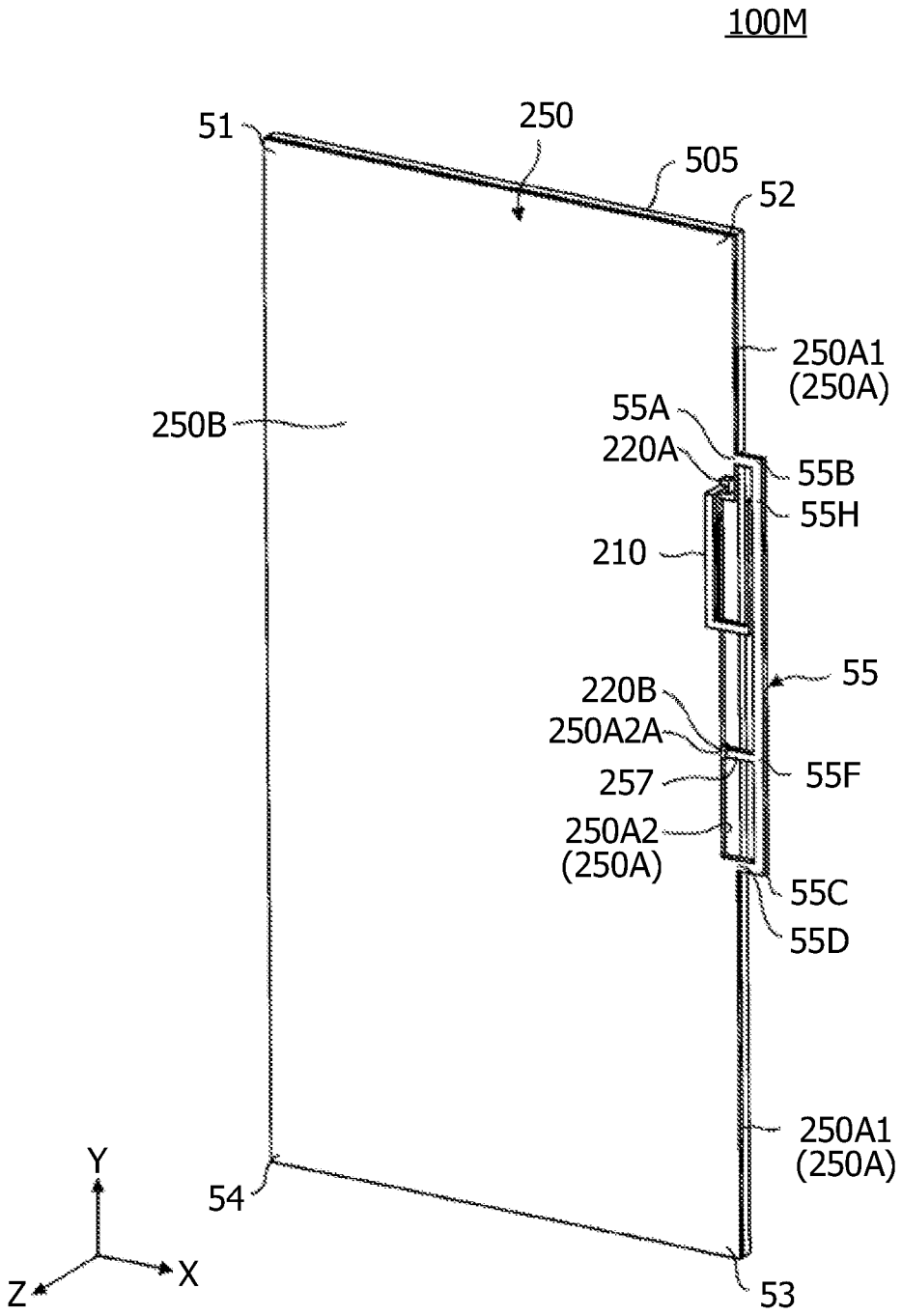
FIG. 15 is a perspective view of an antenna device of an embodiment 2.
Figure 16:
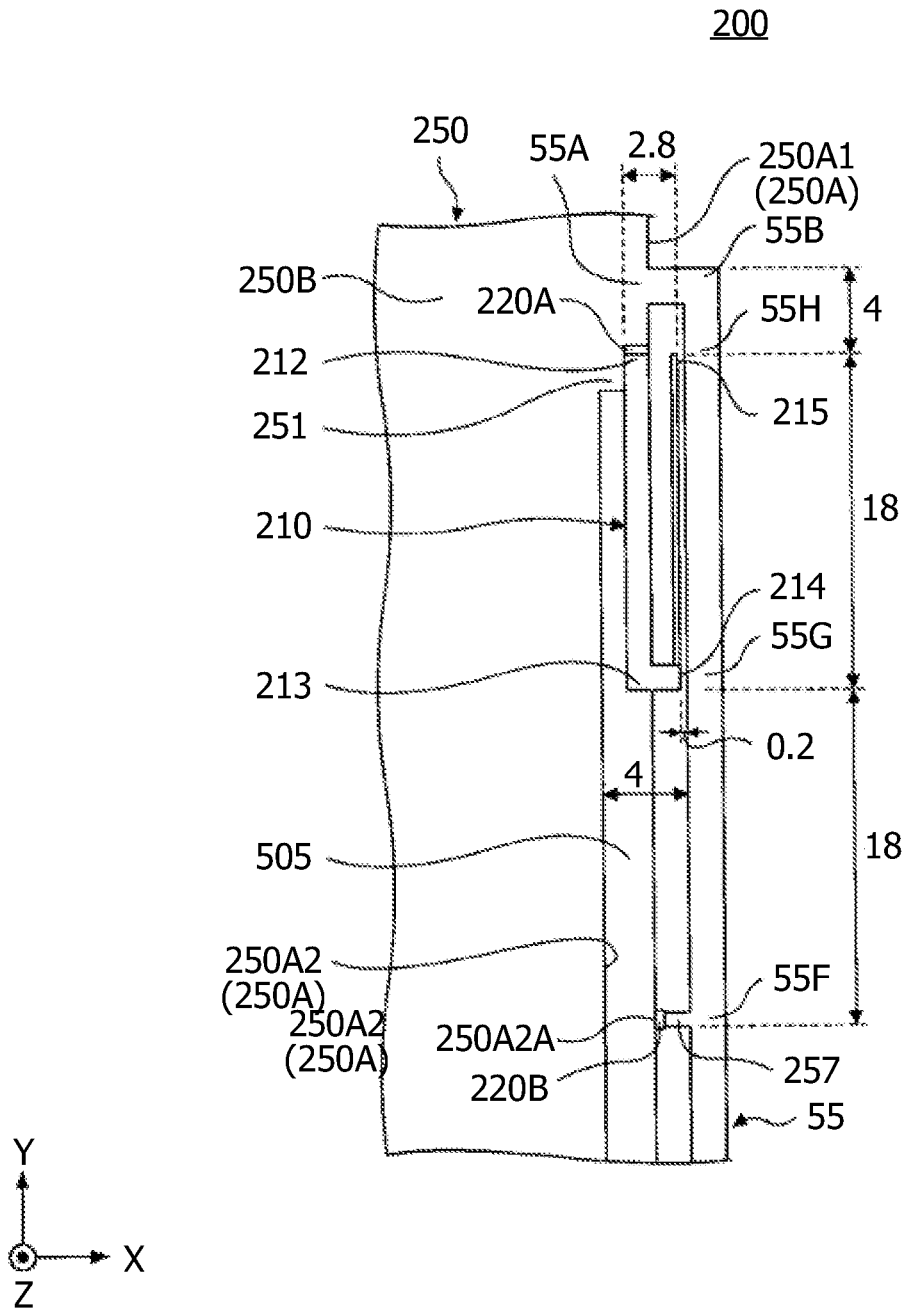
FIG. 16 is a top view enlarging a portion of FIG. 15.
Figure 17:
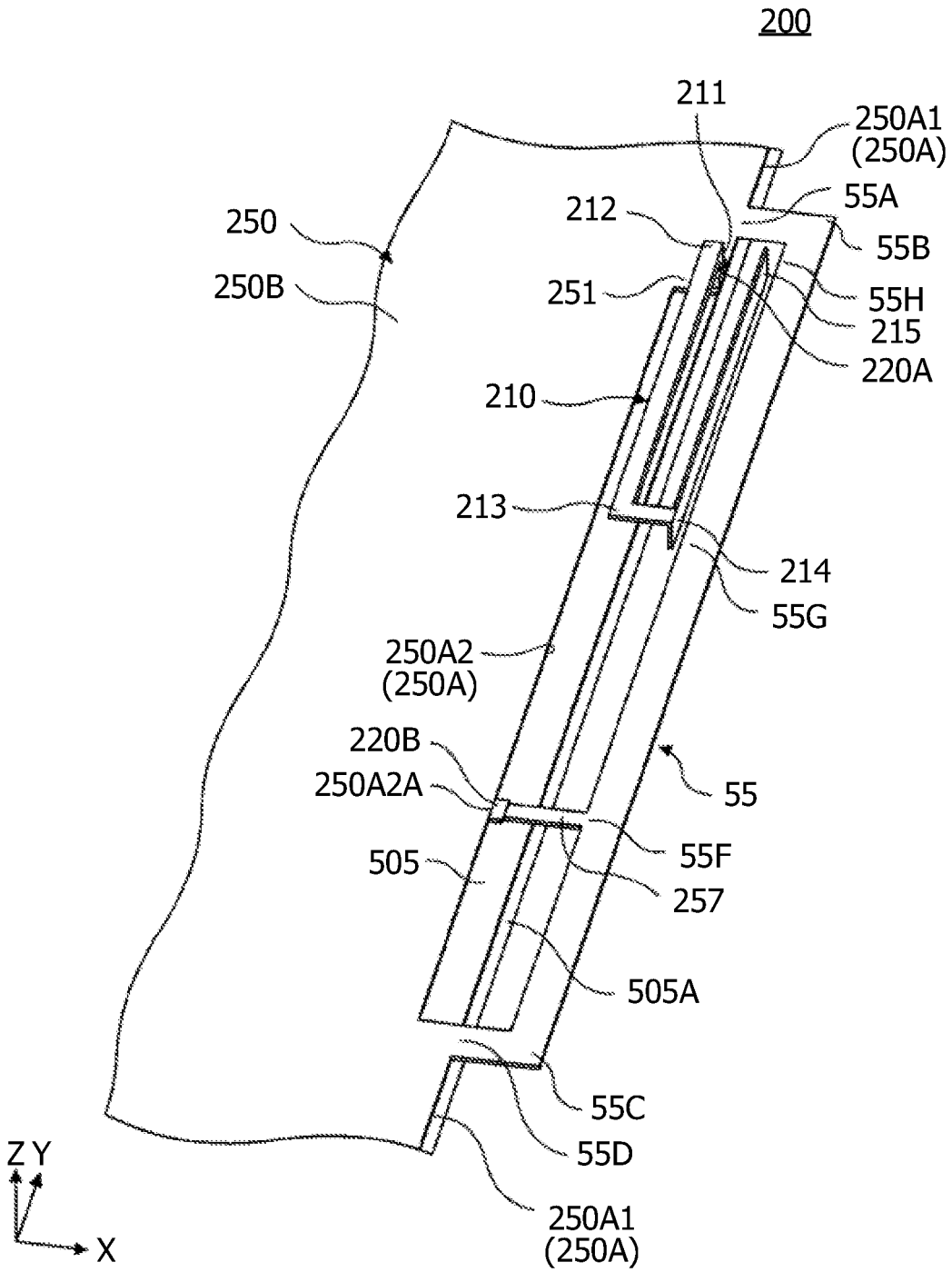
FIG. 17 is a perspective view enlarging the portion of FIG. 15.
Figure 18:
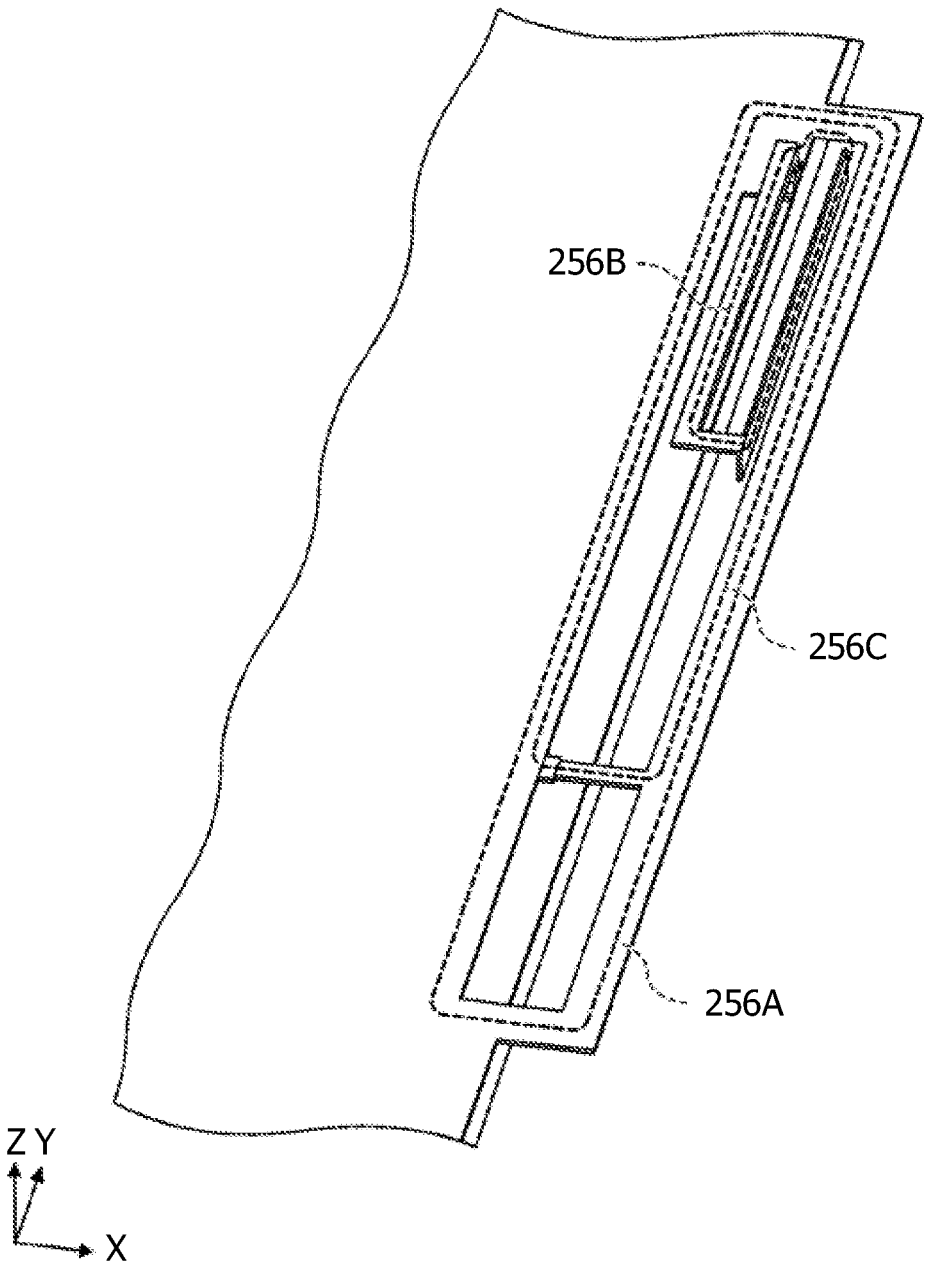
FIG. 18 is a diagram illustrating a loop of a current pathway in the antenna device.

FIG. 15 is a perspective view of an antenna device 200 of an embodiment 2. FIG. 16 is top view enlarging a portion of FIG. 15. FIG. 17 is a perspective view enlarging the portion of FIG. 15. FIG. 18 is a diagram illustrating a loop of a current pathway in the antenna device 200.

The antenna device 200 includes the wiring board 505, a ground plane 250, the frame part 55, a branching line 257, an antenna element 210, and matching circuits 220A and 220B. The antenna device 200 is placed in the tablet computer 500 (see FIG. 1) having the communication capability. The antenna device 200 communicates in at least the three frequency bands of the f1 band, the f2 band, and the f3 band, by way of example. In the following, same components as the components of the antenna device 100 of the embodiment 1 are denoted by same reference numerals, and description of those components is omitted.

Similarly to the ground plane 50 of the embodiment 1, the ground plane 250 is a rectangular metal layer with the apexes 51, 52, 53, and 54, and has an edge 250A between the apexes 52 and 53.

The edge 250A has edges 250A1 and 250A2. The edge 250A1 is located on the Y axis positive direction side than on the connecting end 55A, in a section between the connecting end 55A and an end 251, and on the Y axis negative direction side than on the connecting end 55D. The end 251 is located at a position a predetermined short distance away on the Y axis negative direction side than on the connecting end 55A. The end 251 is an end of a boundary with the edge 250A2 on the Y axis positive direction side, the edge 250A2 being offset to the edge 505A.

The edge 250A2 is located between the end 251 and the connecting end 55D and offset to the edge 505A of the wiring board 505 in the X axis negative direction. Consequently, a surface of the wiring board 505 is exposed between the connecting ends 55A and 55D. The edge 250A2 is an example of an offset section.

The branching line 257 branches from the frame part 55 and extends to go to the edge 250A2 at a point 55F located at a position (position on the bending part 55C side than the midpoint of the bending parts 55B and 55C) closer to the bending part 55C, between the bending part 55B and the bending part 55C of the frame part 55. A tip of the branching line 257 is positioned in front of the edge 250A2 by a predetermined distance, and the matching circuit 220B is inserted between the tip of the branching line 57 and the edge 250A2.

The matching circuit 220A is connected between the core wire of the coaxial cable 570 and a feeding point 211 of the antenna element 210 to match impedance with the antenna element 210 and the ground plane 250.

The matching circuit 220B is inserted in series between the tip of the branching line 257 and a point 250A2A on the edge 250A2 of the ground plane 250 to which the matching circuit 220B is connected. The matching circuit 220B is placed to adjust the electric length of a loop constructed by a section from the branching line 257, the matching circuit 220B, and the point 250A2A on the edge 250A2 to the connecting end 55A on the edge 250A1 through the end 251, and a section between the connecting end 55A and the point 55F of the frame part 55.

Here, a loop constructed by the branching line 257, the matching circuit 220B, and a section between the point 55F and the connecting end 55A of the frame part 55, and a section from the connecting end 55A of the edge 250A1 to the point 250A2A on the edge 250A2 through the end 251 is referred to as a parasitic loop 256C (see FIG. 18). A length of the parasitic loop 256C is set to the electric length of one wavelength in the f3 band.

In addition, a length of a parasitic loop 256A (see FIG. 18) constructed by the section between the connecting ends 55A and 55D on the edges 250A1 and 250A2, and the frame part 55 is set to the electric length of one wavelength in the f1 band. The parasitic loop 256A is an example of a first loop and the parasitic loop 256C is an example of a third loop.

The antenna element 210 includes the feeding point 211, bending parts 212, 213, and 214, and an end 215 and is placed in the vicinity of a surface 250B of the ground plane 250 via the matching circuit 220A.

The antenna element 210 extends from the feeding point 211 to the bending part 212 in the Z axis positive direction; extends from the bending part 212 to the bending part 213 in the Y axis negative direction; extends from the bending part 213 to the bending part 214 in the X axis positive direction; and extends from the bending part 214 to the end 215 in the Y axis positive direction. Such an antenna element 210 is fixed to, for example, the inner surface of the housing 500A (see FIG. 1).

The antenna element 210 is a hairpin-type antenna element, and has a configuration that a section between the bending part 214 and the end 215 extends to return to a section between the bending parts 212 and 213 along the frame part 55. In addition, the antenna element 210 has a configuration that the filmy and linear metal layer such as copper foil is bent.

Here, a section (line) from the feeding point 211 to the bending part 213 is an example of a first line. A section (line) between the bending parts 213 and 214 is an example of a second line. A section (line) between the bending part 214 and the end 215 is an example of a third line.

The feeding point 211 is spaced from the surface 250B of the ground plane 250 at the end 251 and placed in the vicinity of the surface 250B. To the feeding point 211 is connected the core wire of the coaxial cable 570 by way of the matching circuit 220A. The feeding point 211 is connected to the core wire of the coaxial cable 570 via the matching circuit 220A and receives power.

A section from the feeding point 211 to the bending part 212 is a metal layer parallel to an XZ plane. A section from the bending part 212 to the bending part 214 through the bending part 213 is a metal layer parallel to an XY plane. A section from the bending part 214 to the end 215 is a metal layer parallel to a YZ plane.

Thus, spacing (height to the surface 250B) to the surface 250B of the ground plane 250 of a section from the bending part 212 to the bending part 214 is fixed. In addition, spacing (height to the surface 250B) to the surface 250B of the ground plane 250 of the section from the bending part 214 to the end 215 is fixed.

Here, in a section between the bending parts 55B and 55C of the frame part 55, in the Y axis direction, a point matching an end of the bending part 214 on the Y axis negative direction side is referred to as a point 55G. In addition, in the section between the bending parts 55B and 55C of the frame part 55, a point matching the end 215 in the Y axis direction is referred to as a point 55H.

In the bending part 214, the metal layer parallel to the XY plane is bent to the Z axis negative direction to be parallel to the YZ plane. Thus, the section from the bending part 214 to the end 215 has a low height (small spacing in the Z axis direction) to the surface 250B of the ground plane 250 and a surface of the frame part 55, with respect to the section from the bending part 212 to bending part 214.

In addition, although, in planar view, there is spacing (approximately 1 mm in FIG. 16) in the X axis direction between the edge of the section from the bending part 212 to the bending part 213 on the X axis negative direction side and the edge 250A2, the section from the bending part 214 to the end 215, in the X axis direction in planar view, matches the edge of the frame part 55 on the X axis negative direction side.

Consequently, the section from the bending part 214 to the end 215 is adjacent to the section between the bending part 55B of the frame part 55 and the point 55G in the Z axis direction. Such a configuration is adopted to cause the section from the bending part 214 to the end 215 to couple (electromagnetic field coupling) with the frame part 55.

In addition, the line width of the line from the feeding point 211 to the bending part 212 in the X axis direction, the line width from the bending part 213 to the bending part 214 in the Y axis direction, and the line width from the bending part 214 to the end 215 in the Z axis direction are all equal.

The antenna element 210, a section from the point 55H of the frame part 55 to the connecting end 55A, the edge 250A1 between the connecting end 55A and the end 251, and the matching circuit 220A construct a loop 256B (see FIG. 18). A length of the loop 256B is set to the electric length (λ) of one wavelength in the f2 band, including the wavelength shortening effect by the matching circuit 220A. The section from the bending part 214 to the end 215 is coupled to the frame part 55, thus constructing such a loop 256B. The loop 256B is an example of the second loop.

In the antenna device 200, power is fed to the parasitic loops 256A and 256C in the f1 band and the f3 band, by connecting the section between the bending part 214 and the end 215 of the antenna element 210 to the frame part 55. Thus, in order to make the section between the bending part 214 and the end 215 as close as possible to the parasitic loops 256*a* and 256C, the section between the bending part 214 and the end 215 is disposed at a position (position close to the ground plane 250 in the Z axis direction) lower than the section from the bending part 212 to the bending part 214.

As illustrated in FIG. 16, spacing between the edge on the section from the feeding point 211 of the antenna element 210 to the bending part 213 on the X axis negative direction side and the edge on the section between the bending parts 55B and 55C of the frame part 55 on the X axis negative direction side is 2.8 mm.

In addition, a length between the end of the bending part 55B on the Y axis positive direction side and the point 55H is 4 mm. A length between the points 55H and 55G is 18.0 mm. A length between the points 55G and 55F is 18.0 mm. In addition, although unillustrated in FIG. 16, a line width of the antenna element 210 (width of the linear metal layer) is 1 mm, and spacing (height) to the surface of the wiring board 505 of the section between the bending parts 212 and 213 is 1.5 mm. In addition, spacing between the section between bending part 214 and the end 215 and the section between the points 55G and 55H of the frame part 55 in the X axis direction is 0.2 mm. More specifically, the section between the bending part 214 and the end 215 is offset 0.2 mm to the X axis negative direction side, with respect to the edge of the frame part 55 on the X axis negative direction side.

Although unillustrated in FIG. 16, the width of the frame part 55 (width seen on the XY plane) is 2 mm and the length between the bending parts 55B and 55C is 62 mm.

Figure 19:
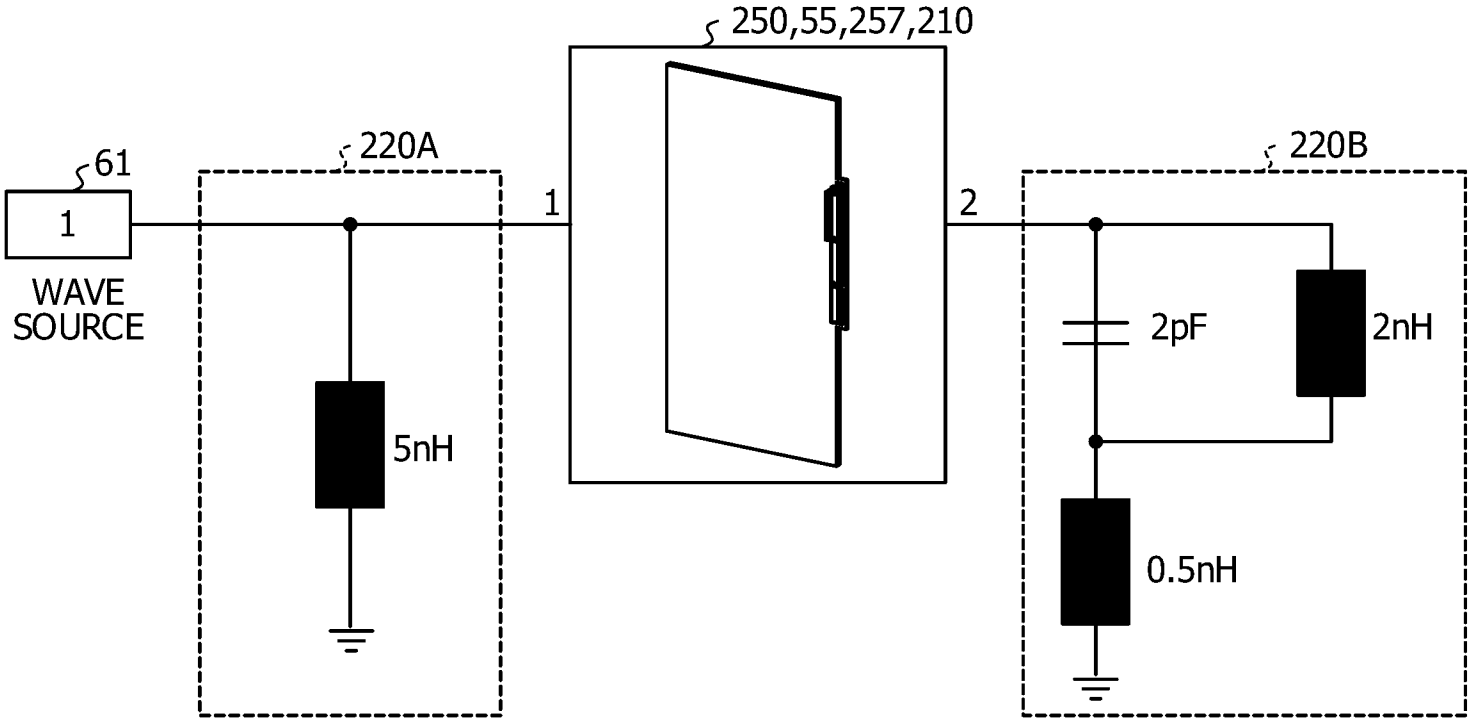
FIG. 19 is a diagram illustrating each parameter of a simulation model of the antenna device.

FIG. 19 is a diagram illustrating each parameter of a simulation model of the antenna device 200. In FIG. 19, the ground plane 250, the frame part 55, the branching line 257, and the antenna element 210 are simplified and illustrated as a block. The port 1 is the feeding point 211 and the port 2 is the tip of the branching line 257.

In addition, the wave source 61 is the high frequency source that supplies the high frequency power to the feeding point 211 (port 1) and the internal impedance is 50Ω.

The simulation model conditions that the ground plane 250 infinitely extends to the directions of the three sides (X axis negative direction, Y axis positive direction, and Y axis negative direction) excluding the edges 250A1 and 250A2. In addition, the conductor such as the ground plane 250, the frame part 55, the branching line 257, and the antenna element 210 shall be the perfect conductor.

The matching circuit 220A is placed, branching from the line between the feeding point 211 and the wave source 61, and has the inductance (5 nH) serially connected to the section to the grounding point. The matching circuit 220B has a circuit configuration that the parallel circuit of the condenser (2 pF) and the inductance (2 nH), and the inductance (0.5 nH) are serially connected in the section to the grounding point.

Figure 20A:
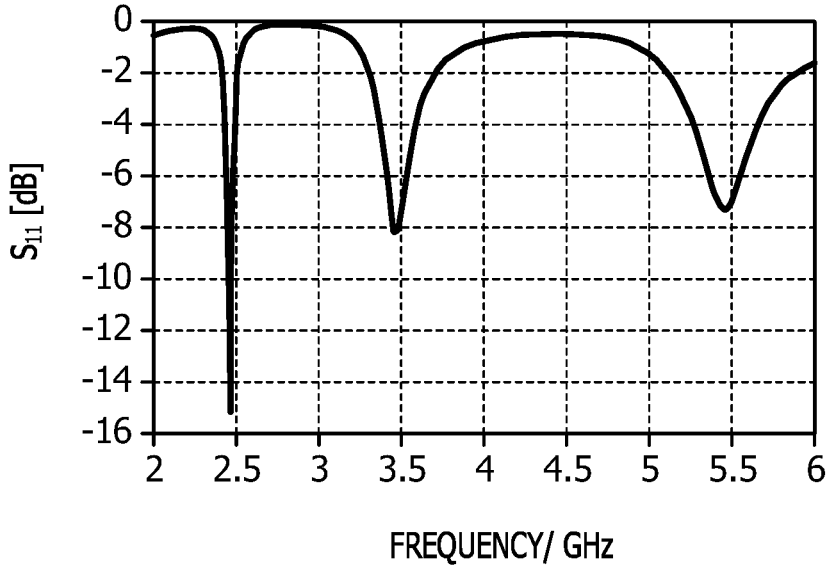
FIGS. 20A and 20B are diagrams illustrating frequency characteristics of a parameter and a total efficiency of the antenna device obtained in the simulation model illustrated in FIG. 19.
Figure 20B:
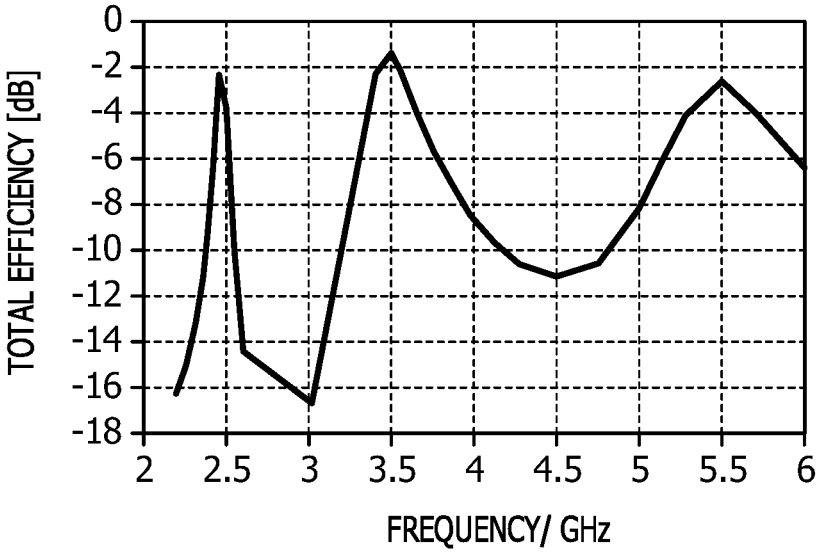

FIGS. 20A and 20B are diagram illustrating frequency characteristics of the $S_{11}$ parameter and the total efficiency of the antenna device 200 obtained in the simulation model illustrated in FIG. 19.

In FIG. 20A, the horizontal axis represents the frequency and the vertical axis represents the value of the $S_{11}$ parameter. As illustrated in FIG. 20A, the $S_{11}$ parameter of the antenna device 200 of the simulation model is approximately −15 dB at 2.45 GHz in the f1 band, approximately −7 dB at 5.5 GHz in the f2 band, and approximately −8 dB at 3.5 GHz in the f3 band.

Around the three frequencies, the band where the $S_{11}$ parameter value is low to some extent is obtained. Thus, it is possible to confirm that communications are enabled in the three bands of the f1 band (2.45 GHz band), the f2 band (5 GHz band), and the f3 band (3.5 GHz band).

In addition, as illustrated in FIG. 20B, a good value is obtained for the total efficiency, such as approximately −2.5 dB at 2.45 GHz, approximately −3 dB at 5 GHz, and approximately −1.5 dB at 3.5 GHz. Thus, also around the three frequencies, a band where the total efficiency is high to some extent is obtained.

Figure 21C:
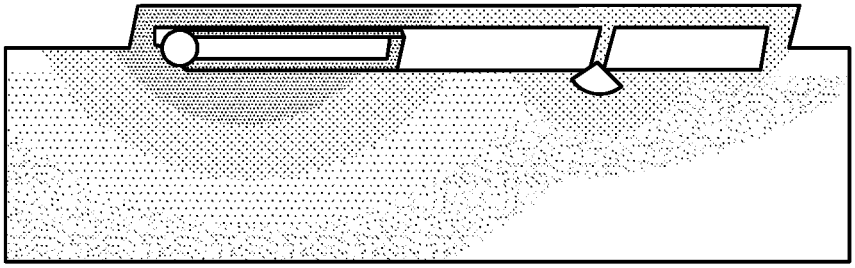
FIGS. 21A and 21C are diagrams illustrating a current distribution of a ground plane, the frame part, the parasitic loop, and an antenna element.
Figure 21B:
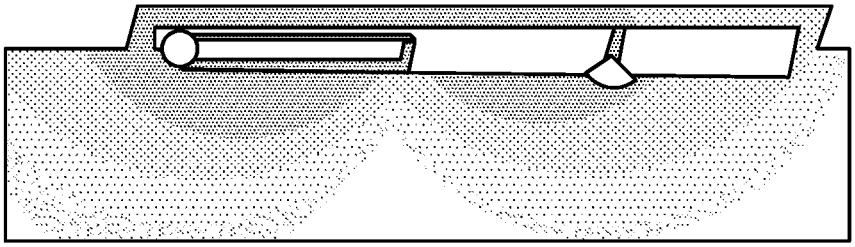
Figure 21A:
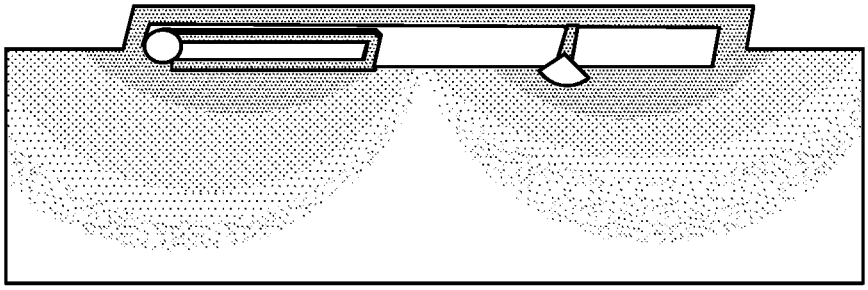

FIGS. 21A to 21C are diagrams illustrating a current distribution of the ground plane 250, the frame part 55, the parasitic loop 56, and the antenna element 210. In electromagnetic field simulation, the current distribution is determined under the condition that power is fed to the feeding point 211 of the antenna element 210. The current distribution indicates that the darker (black) the color is, the higher the current value is, and the lighter (white) the color is, the lower the current value is. Note that symbols are omitted in FIGS. 21A to 21C.

FIG. 21A illustrates the current distribution when power is fed at 2.45 GHz. As illustrated in FIG. 21A, at both ends of the parasitic loop 256A (see FIG. 18) in the Y axis direction are generated one each of antinodes of a standing wave (two in total), the parasitic loop 256A being constructed by the edges 250A1 and 250A2 and the connecting ends 55A and 55D of the frame part 55. This reveals that the standing wave corresponding to one wavelength is generated in the parasitic loop 256A.

Since the section between the bending part 214 and the end 215 of the antenna element 210 is coupled to the frame part 55, power is fed to the parasitic loop 256A via the antenna element 210. It is believed that this causes resonance at 2.45 GHz. Note that such resonance may also be confirmed around 2.45 GHz (frequency band included in the f1 band).

FIG. 21B illustrates the current distribution when power is fed at 5.5 GHz. As illustrated in FIG. 21B, in the loop 256B (see FIG. 18) including the antenna element 210, and the section between the connecting end 55A and the point 55H of the frame part 55, antinodes (two antinodes in total) are generated in the vicinity of the feeding point 211 and around the center of the section between the bending part 214 and the end 215. This reveals that the standing wave corresponding to one wavelength is generated.

Since the section between the bending part 214 and the end 215 of the antenna element 210 is coupled to the frame part 55, it is believed that a resonance current of 5.5 GHz flows to the loop 256B including the antenna element 210, and the section between the connecting end 55A and the point 55H of the frame part 55. Note that such resonance may also be confirmed around 5.5 GHz (frequency band included in the f2 band).

FIG. 21C illustrates the current distribution when power is fed at 3.5 GHz. As illustrated in FIG. 21C, two antinodes of the standing wave are generated at the parasitic loop 256C (see FIG. 18) constructed by the branching line 257, the matching circuit 220B, the section between the point 55F and the connecting end 55A of the frame part 55, and the section from the connecting end 55A of the edge 250A1 to the point 250A2A on the edge 250A2 through the end 251. This reveals that the standing wave corresponding to one wavelength of 3.5 GHz is generated in the parasitic loop 256C. Note that such resonance may also be confirmed around 3.5 GHz (frequency band included in the f3 band).

As described above, according to the embodiment 2, the section between the bending part 214 and the end 215 of the antenna element 210 being coupled to the frame part 55, the resonance current of the f1 band flows to the parasitic loop 256A including the edges 250A1 and 250A2 and the entire frame part 55.

In addition, with coupling of the antenna element 210 to the frame part 55, resonance power of the f2 band flows to the loop 256B constructed by the antenna element 210, and the section between the point 55H and the connecting end 55A of the frame part 55.

Furthermore, with coupling of the antenna element 210 to the frame part 55, the resonance current of the f3 band flows to the parasitic loop 256C constructed by the branching line 257, the matching circuit 220B, the section between the point 55F and the connecting end 55A of the frame part 55, and the section from the connecting end 55A of the edge 250A1 to the point 250A2A on the edge 250A2 through the end 251.

Therefore, the antenna device 200 may be provided that communicates in the plurality of frequency bands. The parasitic loop 256C utilizing the antenna element 210 may be used in communications of a multi-input multi-output (MIMO) format, for example. Similarly to the antenna device 100 of the embodiment 1, the antenna device 200 of the embodiment 2 may also implement the communications in the 4×4 MIMO format.

In addition, the antenna device 200 constructs the parasitic loops 256A and 256C, utilizing the frame part 55 that protrudes from the ground plane 250 to the X axis positive direction. Like the electronic equipment 500, if there is a restriction on a space to dispose the antenna element 210, increasing communication frequencies by utilizing the parasitic loops 256A and 256C is efficient in allocating a space within the housing 500A of the electronic equipment 500 to various components.

Note that in the above, in the X axis direction, the configuration is described in which the section between the bending part 214 and the end 215 does not match the section between the points 55G and 55H of the frame part 55, and there is spacing of 0.2 mm. For example, if the antenna element 210 is placed on the housing 500A, there may be a case in which matching is not possible due to a structural reason or the like, or a case in which a manufacturing error leads to slight misalignment. In addition, some space may be left for any other reasons.

However, the section from the bending part 214 to the end 215 may be disposed so as to match the section between the points 55G and 55H of the frame part 55. If the section from the bending part 214 to the end 215 matches the section between the points 55G and 55H of the frame part 55, the section from the bending part 214 to the end 215 is closest to the frame part 55, which thus strengthens the coupling and makes it possible to further increase the current in the frame part 55.

Embodiment 3

Figure 22:
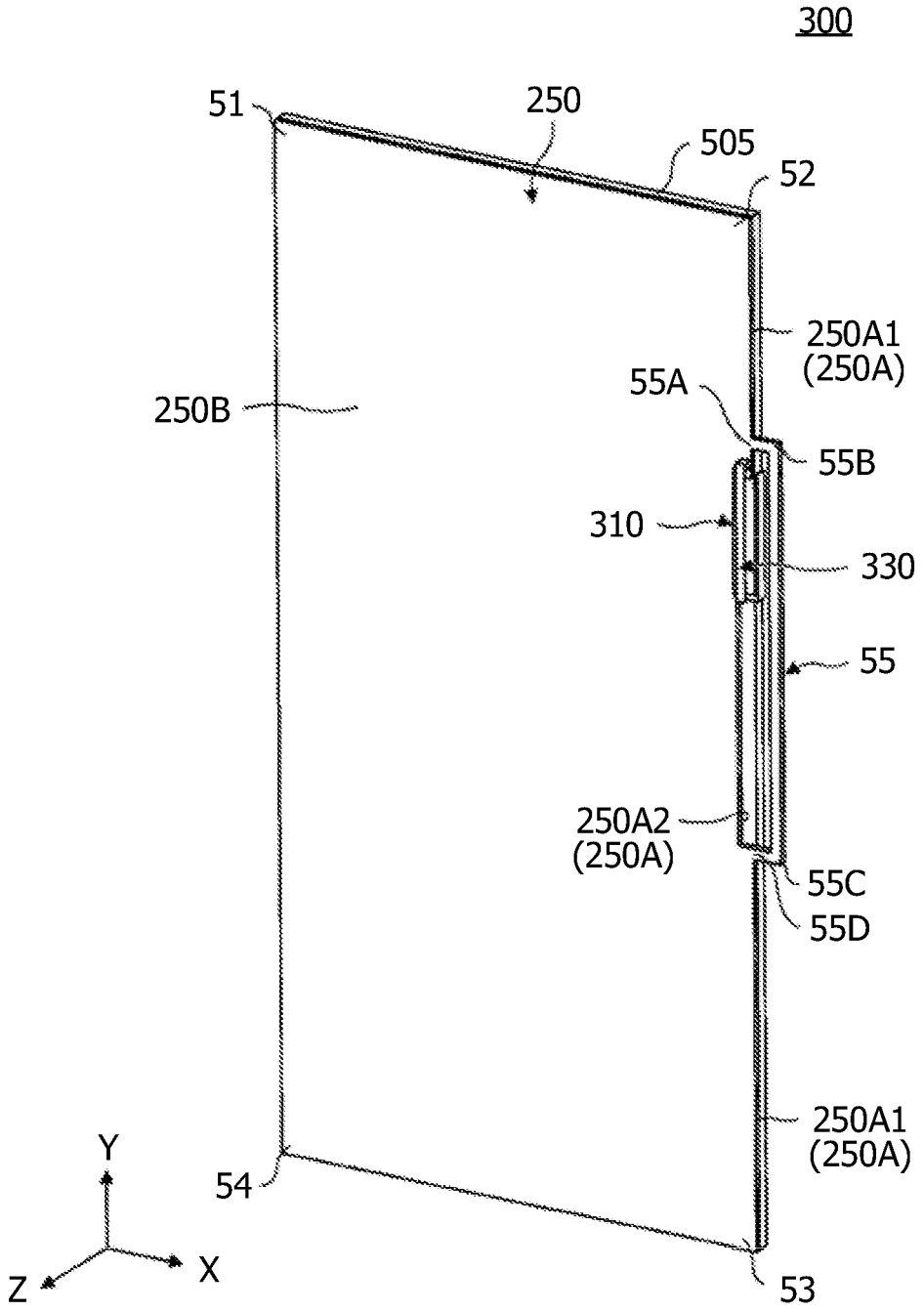
FIG. 22 is a perspective view of an antenna device of an embodiment 3.
Figure 23:
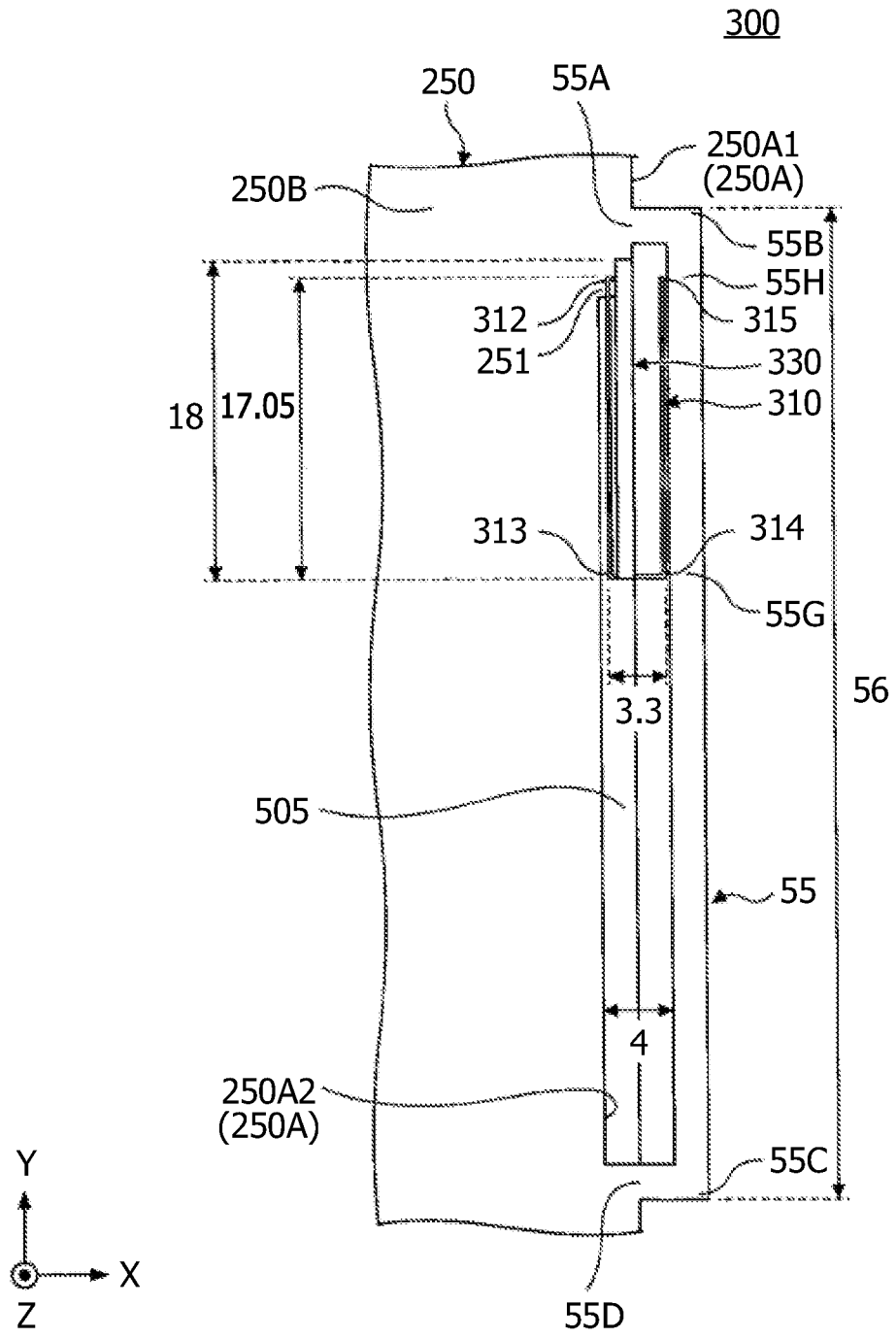
FIG. 23 is a top view enlarging a portion of FIG. 22.
Figure 24:
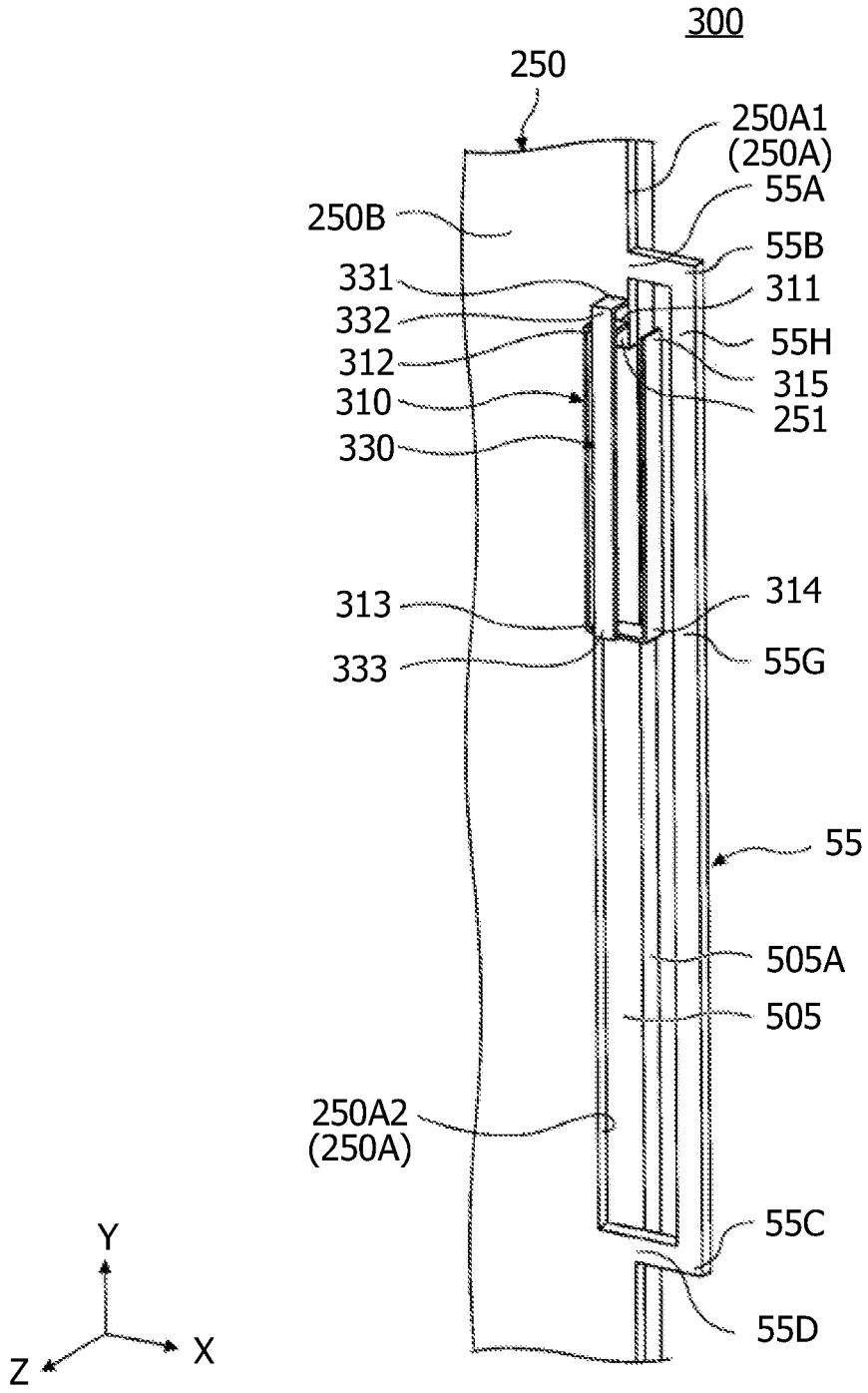
FIG. 24 is a perspective view enlarging the portion of FIG. 22.
Figure 25A:
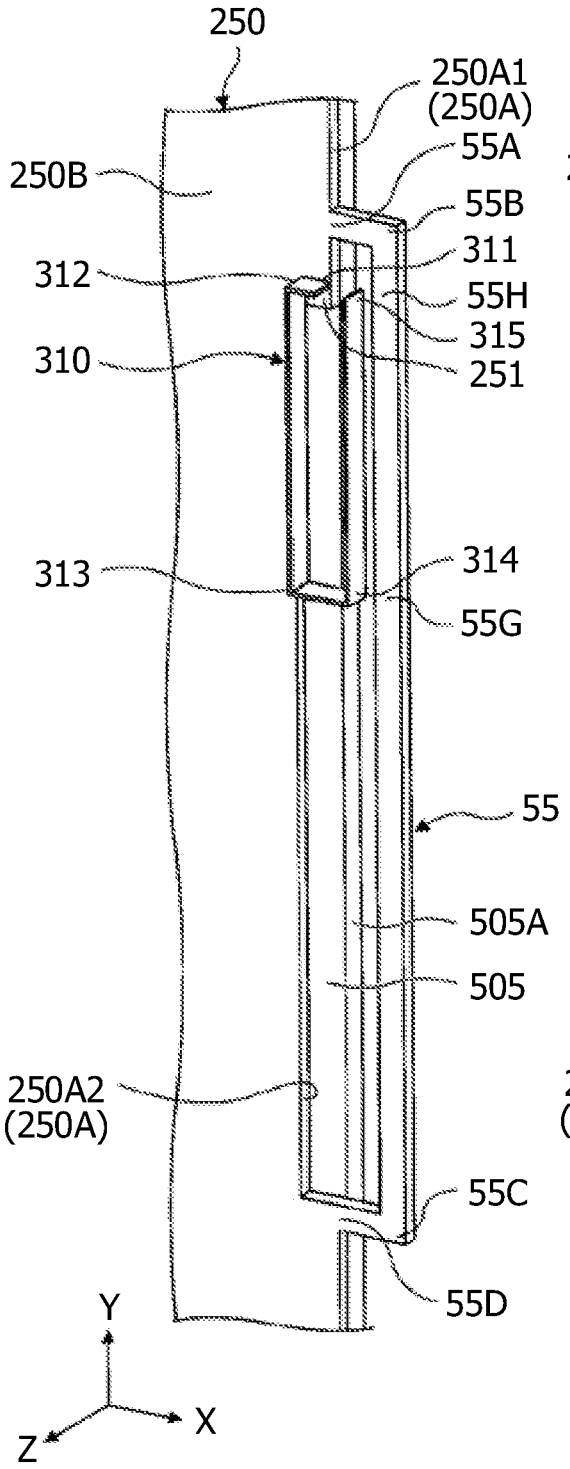
FIGS. 25A and 25B are diagrams illustrating a state in which an antenna element and a parasitic element are removed from FIG. 24.
Figure 25B:
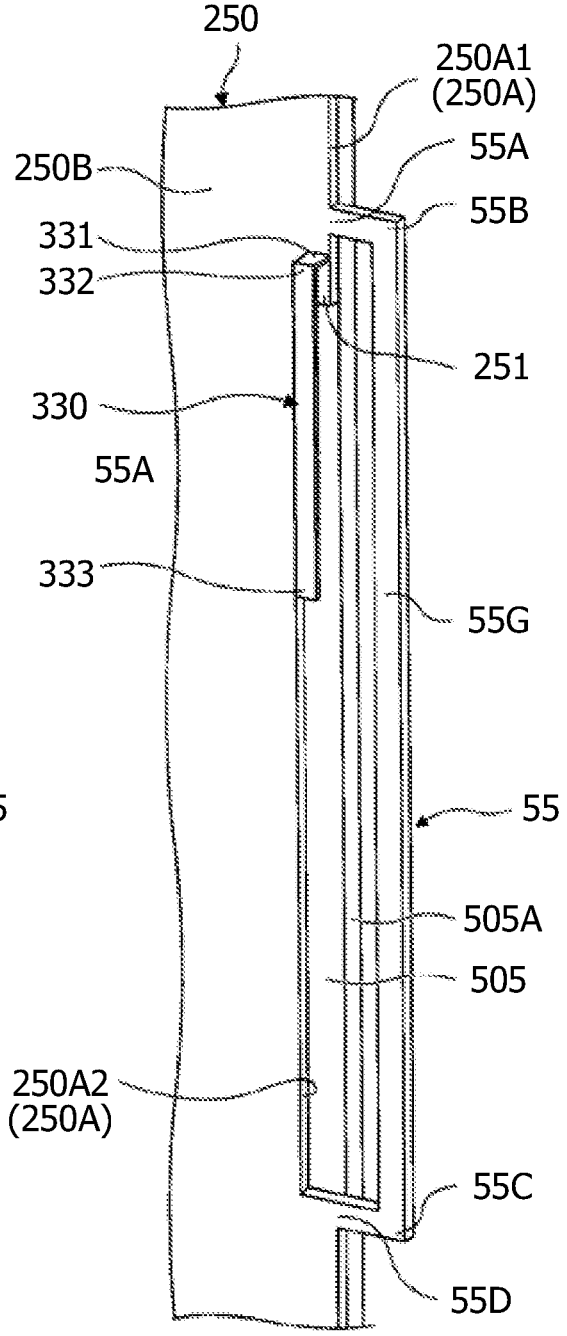
Figure 26:
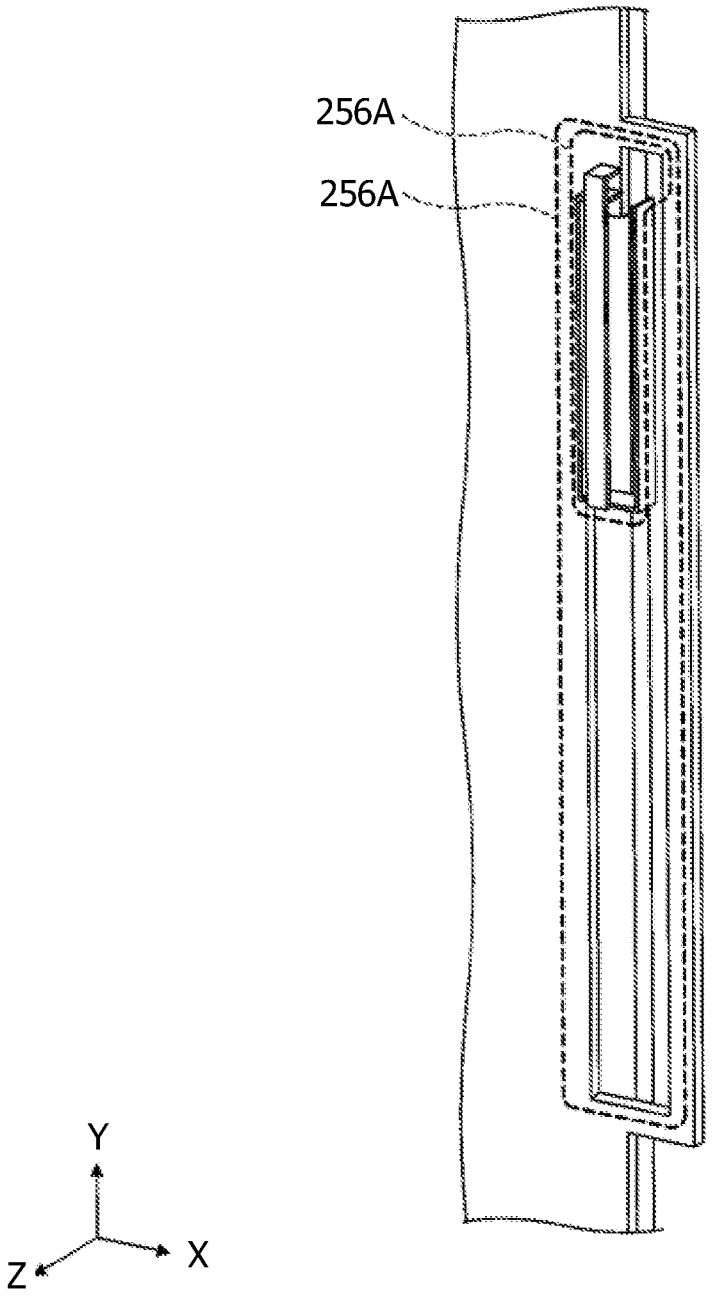
FIG. 26 is a diagram illustrating a loop of a current pathway in the antenna device.

FIG. 22 is a perspective view of an antenna device 300 of an embodiment 3. FIG. 23 is a top view enlarging a portion of FIG. 22. FIG. 24 is a perspective view enlarging the portion of FIG. 22. FIGS. 25A and 25B are diagram illustrating a state in which an antenna element 310 and a parasitic element 330 are removed from FIG. 24. FIG. 26 is a diagram illustrating a loop of a current pathway in the antenna device 300.

The antenna device 300 includes the wiring board 505, the ground plane 250, the frame part 55, the antenna element 310, and the parasitic element 330. The antenna device 300 is placed in the tablet computer 500 (see FIG. 1) having the communication capability. The antenna device 300 communicates in at least the three frequency bands of the f1 band, the f2 band, and the f3 band, by way of example. In the following, same components as the components of the antenna devices 100 and 200 of the embodiments 1 and 2 are denoted by same reference numerals, and description of those components is omitted. Note that the antenna device 300 includes no matching circuit.

The ground plane 250 and the frame part 55 are same as the ground plane 250 and the frame part 55 of the embodiment 2. The length of the parasitic loop 256A (see FIG. 26) constructed by the section between the connecting ends 55A and 55D on the edges 250A1 and 250A2, and the frame part 55 is set to the electric length of one wavelength in the f1 band.

The antenna element 310 includes a feeding point 311, bending parts 312, 313, and 314, and an end 315, and is placed in the vicinity of the surface 250B of the ground plane 250. Although power is fed to the feeding point 311 without going through a matching circuit, the matching circuit may be placed if the impedance is adjusted.

The antenna element 310 extends from the feeding point 311 to the bending part 312 in the X axis negative direction; extends from the bending part 312 to the bending part 313 in the Y axis negative direction; extends from the bending part 313 to the bending part 314 in the X axis positive direction; and extends from the bending part 314 to the end 315 in the Y axis positive direction. Such an antenna element 310 is fixed to, for example, the inner surface of the housing 500A (see FIG. 1).

The antenna element 310 is the hairpin-type antenna element, and has the configuration that a section between the bending part 314 and the end 315 extends so as to return to the section between the bending parts 312 and 313 along the frame part 55. In addition, the antenna element 310 has the configuration that the filmy and linear metal layer such as copper foil is bent.

Here, a section (line) from the feeding point 311 to the bending part 313 is an example of the first line. A section (line) between the bending parts 313 and 314 is an example of the second line. A section (line) between the bending part 314 and the end 315 is an example of the third line.

The feeding point 311 is spaced from the surface 250B of the ground plane 250 at the end 251 and placed in the vicinity of the surface 250B. The core wire of the coaxial cable 570 is connected to the feeding point 311 and power is fed to the feeding point 311.

A section from the feeding point 311 to the bending part 312 is a metal layer parallel to the XZ plane. A section from the bending part 312 to the bending part 313 is a metal layer parallel to the YZ plane. A section from the bending part 313 to the bending part 314 is a metal layer parallel to the XZ plane. A section from the bending part 314 to the end 315 is a metal layer parallel to the YZ plane.

Thus, spacing (height to the surface 250B) of all of the sections from the feeding point 311 to the end 315, with the surface 250B of the ground plane 250 is fixed.

Here, in the section between the bending parts 55B and 55C of the frame part 55, in the Y axis direction, the point matching the end of the bending part 314 on the Y axis negative direction side is referred to as the point 55G. In addition, in the section between the bending parts 55B and 55C of the frame part 55, the point matching the end 315 in the Y axis direction is referred to as the point 55H.

The section from the bending part 312 to the bending part 313 is offset to the X axis positive direction side than the edge 250A2 in planar view. The section from the bending part 314 to the end 315 matches the edge of the section between the points 55G and 55H of the frame part 55 on the X axis negative direction side, in planar view.

Consequently, the section from the bending part 314 to the end 315 is adjacent to the section between the points 55G and 55H of the frame part 55 in the Z axis direction. Such a configuration is adopted to cause the section from the bending part 314 to the end 315 to couple (electromagnetic field coupling) with the frame part 55. Such a configuration couples the section from the bending part 314 to the end 315 to the frame part 55 (electromagnetic field coupling) and feeds power from the antenna element 310 to the frame part 55.

In addition, the line widths from the feeding point 311 to the end 315 in the Z axis direction is all equal. Note that by way of example, spacing (height to the surface of the wiring board 505) of the edges of all of the sections from the feeding point 311 to the end 315 on the Z axis positive direction side with the surface of the wiring board 505 is 1.5 mm.

The antenna element 310, the section from the point 55H of the frame part 55 to the connecting end 55A, and the section along the edge 250A1 between the connecting end 55A and the end 251 construct a loop 356B (see FIG. 26). A length of the loop 356B is set to the electric length (λ) of one wavelength in the f2 band. The section from the bending part 314 to the end 315 is coupled to the frame part 55, thus constructing such a loop 356B.

In the antenna device 300, power is fed to the parasitic loops 256A of the f1 band, by connecting the section between the bending part 314 and the end 315 of the antenna element 310 to the frame part 55. Thus, the section between the bending parts 312 and 313 is offset more to the X axis positive direction side than the edge 250A2, in planar view. Moreover, the section between the bending part 314 and the end 315 is caused to match the edge of the section between the points 55G and 55H of the frame part 55 on the X axis negative direction side, in planar view. This is to couple the section between the bending part 314 and the end 315 to the parasitic loop 256A.

Note that the section from the feeding point 311 to the bending part 312 extends in the X axis negative direction to bypass the parasitic element 330 that is connected to the end 251.

In addition, the parasitic loop 256A is an example of the first loop and the loop 356B is an example of the second loop.

The parasitic element 330 is an inverted-L type parasitic element and includes a connecting part 331, a bending part 332, and an end 333. The connecting part 331 being connected to the surface of the end 251 (more specifically, the surface of the ground plane 250), the parasitic element 330 extends from the connecting part 331 to the bending part 332 in the Z axis positive direction, and extends from the bending part 332 to the end 333 in the Y axis negative direction. The parasitic element 330 extends along the Y axis direction within an area enclosed by the antenna element 310 in planar view.

The parasitic element 330 has a configuration in which the filmy and linear metal layer such as copper foil is bent. The section between the connecting part 331 and the bending part 332 is a metal layer parallel to the XZ plane, and the section between the bending part 332 and the end 333 is a metal layer parallel to the XY plane. By way of example, spacing to the surface of the wiring board 505 (height to the surface of the wiring board 505) of the section between the bending part 332 and the end 333 is 1.7 mm.

The end 333, and the section between the bending parts 313 and 314 of the antenna element 310 have equal positions in the Y axis direction, and the end 333 is positioned in the section between the bending parts 313 and 314 of the antenna element 310 on the Z axis positive direction side.

A length from the connecting part 331 to the end 333 of the parasitic element 330 is set to the electric length of a quarter wavelength of the f3 band. This is to cause the parasitic element 330 to act as a monopole type parasitic element. The parasitic element 330 is coupled to the section between the bending parts 312 and 313 of the antenna element 310 and receives power fed from the antenna element 310.

As illustrated in FIG. 23, by way of example, a length of the section between the bending parts 312 and 313 of the antenna element 310 is 17.05 mm. A length of the section between the bending part 332 and the connecting part 331 of the parasitic element 330 is 18 mm. Positions of the end of the bending part 313 and the end of the connecting part 331 in the Y axis negative direction are equal.

Note that although dimensions are not illustrated in FIG. 23, spacing between the section between the bending part 314 and the end 315 and the section between the points 55G and 55H of the frame part 55 in the X axis direction is 0.2 mm. More specifically, the section between the bending parts 314 and 315 is offset 0.2 mm to the X axis negative direction side, with respect to the edge of the frame part 55 on the X axis negative direction side.

In addition, a length between the bending parts 313 and 314 of the antenna element 310 is 3.3 mm. In addition, a length of the section between the bending parts 55B and 55C of the frame part 55 is 56 mm. The width of the frame part 55 (width seen on the XY plane) is 2 mm. Spacing between the edge 250A2 and the edge of the section between the bending parts 55B and 55C of the frame part 55 on the X axis negative direction side is 4 mm.

Figure 27A:
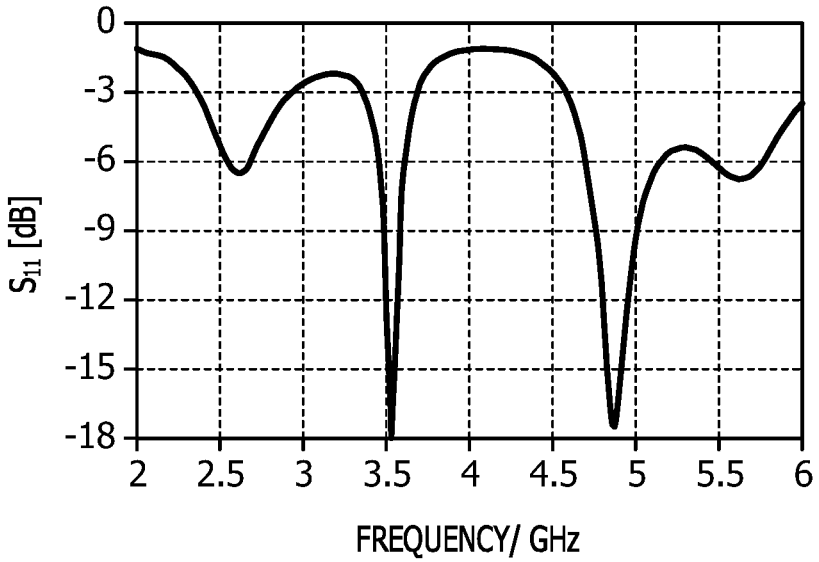
FIGS. 27A and 27B are diagram illustrating a simulation result of frequency characteristics of a parameter and a total efficiency of the antenna device.
Figure 27B:
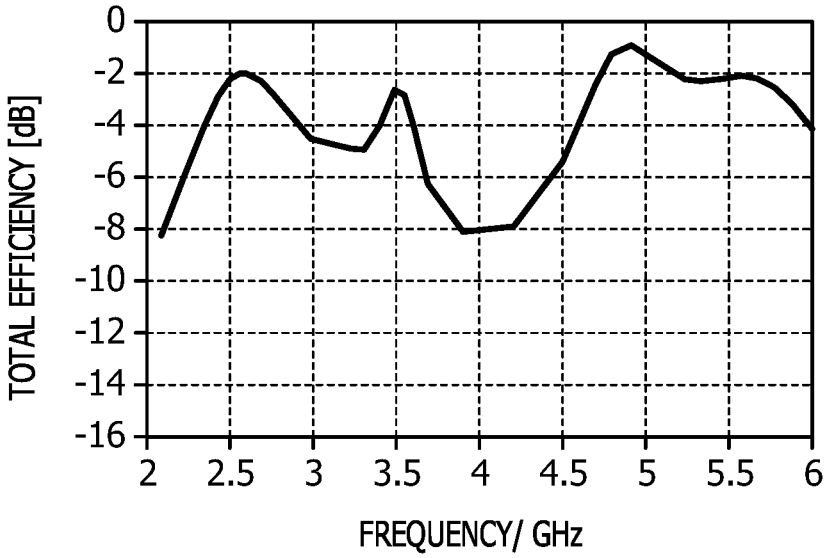

FIGS. 27 and 27B are diagrams illustrating a simulation result of frequency characteristics of the $S_{11}$ parameter and the total efficiency of the antenna device 300.

In FIG. 27A, the horizontal axis represents the frequency and the vertical axis represents the value of the $S_{11}$ parameter. As illustrated in FIG. 27A, the $S_{11}$ parameter of the antenna device 300 of the simulation model is approximately −5 dB at 2.45 GHz in the f1 band, approximately −15 dB and approximately −6 dB respectively at 4.9 GHz and 5.5 GHz in the f2 band, and approximately −18 dB or lower at 3.5 GHz in the f3 band.

Around the four frequencies, the band where the $S_{11}$ parameter value is low to some extent is obtained. Thus, it is possible to confirm that communications are enabled in the three bands of the f1 band (2.45 GHz band), the f2 band (5 GHz band), and the f3 band (3.5 GHz band).

In addition, as illustrated in FIG. 27B, a good value is obtained for the total efficiency, such as approximately −2.5 dB at 2.45 GHz, approximately −0.5 dB at 4.9 GHz, approximately −2 dB at 5.5 GHz, and approximately −3 dB at 3.5 GHz. Thus, also around the four frequencies, a band where the total efficiency is high to some extent is obtained.

FIGS. 28A to 28D are diagrams illustrating a current distribution of the ground plane 250, the frame part 55, the antenna element 310, and the parasitic element 330. In electromagnetic field simulation, the current distribution is determined under the condition that power is fed to the feeding point 311 of the antenna element 310. The current distribution indicates that the darker (black) the color is, the higher the current value is, and the lighter (white) the color is, the lower the current value is. Note that symbols are omitted in FIGS. 28A to 28D.

Figure 28D:
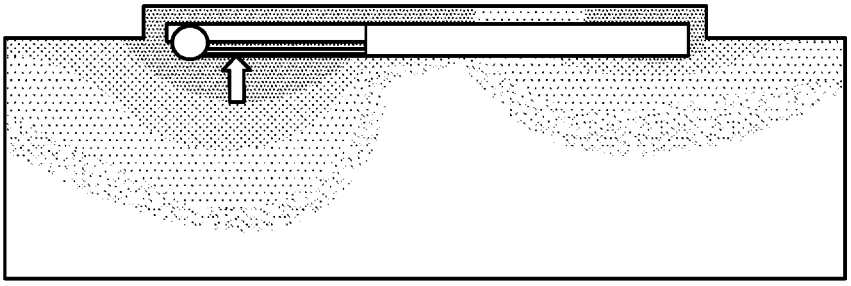
FIGS. 28A to 28D are diagrams illustrating a current distribution of the ground plane, the frame part, the antenna element, and the parasitic element.
Figure 28C:
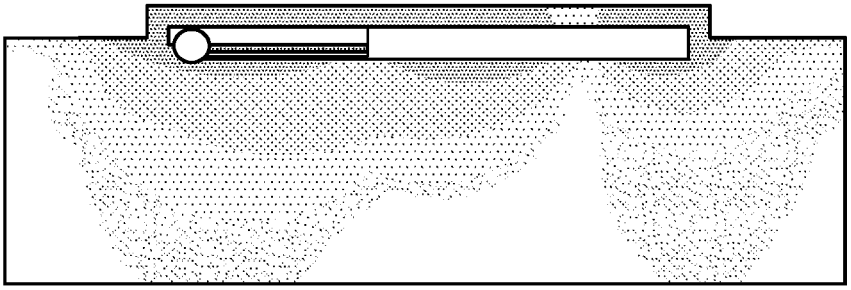
Figure 28B:
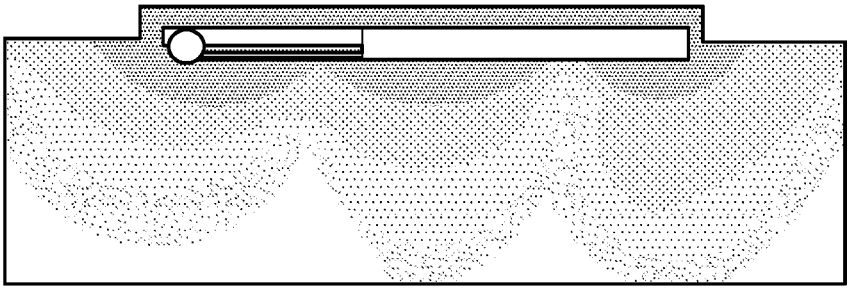
Figure 28A:
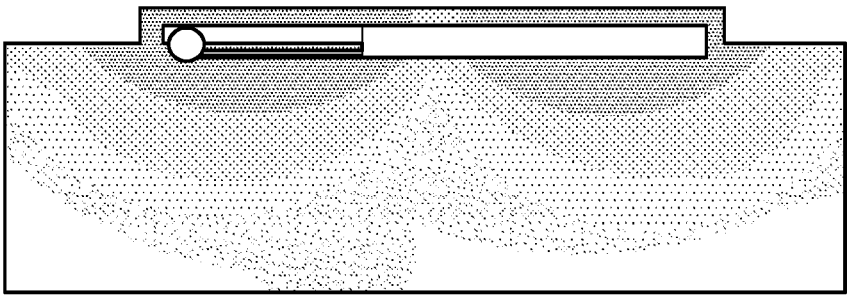

FIG. 28A illustrates the current distribution when power is fed at 2.5 GHz. As illustrated in FIG. 28A, at both ends of the parasitic loop 256A (see FIG. 26) in the Y axis direction are generated one each of antinodes of a standing wave (two in total), the parasitic loop 256A being constructed by the edges 250A1 and 250A2 and the connecting ends 55A and 55D of the frame part 55. This reveals that the standing wave corresponding to one wavelength is generated in the parasitic loop 256A.

Since the section between the bending part 314 and the end 315 of the antenna element 310 is connected to the frame part 55, power is fed to the parasitic loop 256A by way of the antenna element 310. It is believed that this causes resonance at 2.5 GHz. Note that such resonance may also be confirmed around 2.5 GHz (frequency band included in the f1 band).

FIG. 28B illustrates the current distribution when power is fed at 4.9 GHz. As illustrated in FIG. 28B, four antinodes of the standing wave are generated in the parasitic loop 256A (see FIG. 26), revealing that the standing wave corresponding to two wavelengths are generated. The two of the four antinodes lie at the connecting ends 55A and 55D, and the remaining two lie around the center of the edge 250A2 in the Y axis direction and around the center of the frame part 55 in the Y axis direction. This indicates that resonance of second order harmonic of 2.5 GHz are generated.

FIG. 28C illustrates the current distribution when power is fed at 5.5 GHz. As illustrated in FIG. 28C, in the loop 356B (see FIG. 26) including the antenna element 310, and the section between the connecting end 55A and the point 55H of the frame part 55, antinodes (two antinodes in total) are generated in the vicinity of the feeding point 311 and around the center of the section between the bending part 314 and the end 315. This reveals that the standing wave corresponding to one wavelength is generated.

Since the section between the bending part 314 and the end 315 of the antenna element 310 is coupled to the frame part 55, it is believed that a resonance current of 5.5 GHz flows to the loop 356B including the antenna element 310, and the section between the connecting end 55A and the point 55H of the frame part 55. Note that such resonance may also be confirmed around 5.5 GHz (frequency band included in the f2 band).

FIG. 28D illustrates the current distribution when power is fed at 3.5 GHz. As illustrated in FIG. 28D, the current value at a point depicted by an arrow in the vicinity of the bending part 332 of the parasitic element 330 is highest, which reveals that the parasitic element 330 acts as the monopole element, causing resonance. Note that such resonance may also be confirmed around 3.5 GHz (frequency band included in the f3 band).

As described above, according to the embodiment 3, the section between the bending part 314 and the end 315 of the antenna element 310 being coupled to the frame part 55, the resonance current of 4.9 GHz of the f1 band and the f2 band flows the parasitic loop 256A including the edges 250A1 and 250A2 and the entire frame part 55.

In addition, the antenna element 310 and the frame part 55 being coupled, the resonance current of 5.5 GHz of the f2 band flows to the loop 356B constructed by the antenna element 310 and the section between the point 55H and the connecting end 55A of the frame part 55.

Furthermore, the parasitic element 330 is coupled to the section between the bending parts 312 and 313 of the antenna element 310. By receiving power fed from the antenna element 310, the resonance current of the f3 Band flows to the parasitic element 330.

Therefore, the antenna device 300 may be provided that communicates in the plurality of frequency bands. The parasitic element 330 may be used in the communications of the multi-input multi-output (MIMO) format, for example. Similarly to the antenna device 100 of the embodiment 1, the antenna device 300 of the embodiment 3 may also implement the communications in the 4×4 MIMO format.

In addition, the antenna device 300 constructs the parasitic loop 256A, utilizing the frame part 55 that protrudes from the ground plane 250 to the X axis positive direction. Like the electronic equipment 500, if there is a restriction on a space to dispose the antenna element 310, increasing communication frequencies by utilizing the parasitic loop 256A is efficient in allocating a space within the housing 500A of the electronic equipment 500 to various components.

Note that in the above, in the X axis direction, the configuration is described in which the section between the bending part 314 and the end 315 does not match the section between the points 55G and 55H of the frame part 55, and there is spacing of 0.2 mm. For example, if the antenna element 310 is placed on the housing 500A, there may be a case in which matching is not possible due to a structural reason or the like, or a case in which a manufacturing error leads to slight misalignment. In addition, some space may be left for any other reasons.

However, the section from the bending part 314 to the end 315 may be disposed so as to match the section between the points 55G and 55H of the frame part 55. If the section from the bending part 314 to the end 315 matches the section between the points 55G and 55H of the frame part 55, the section from the bending part 314 to the end 315 is closest to the frame part 55, which thus strengthens the coupling and makes it possible to further increase the current in the frame part 55.

Figure 29A:
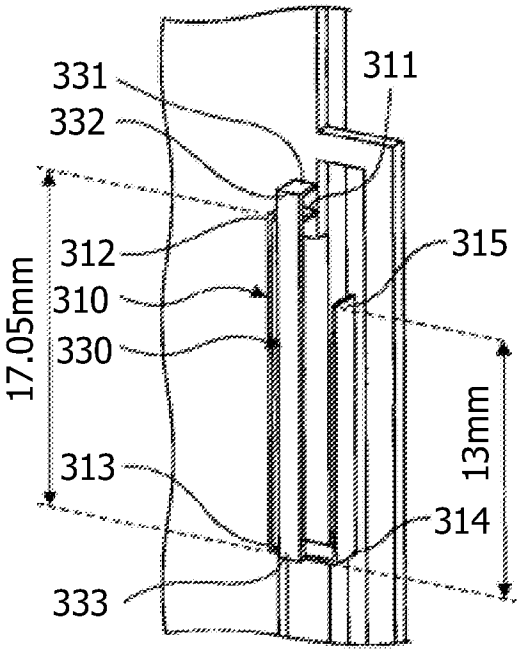
FIGS. 29A to 29C are diagrams illustrating the antenna element having a different length of a section between a bending part and an end.
Figure 29B:
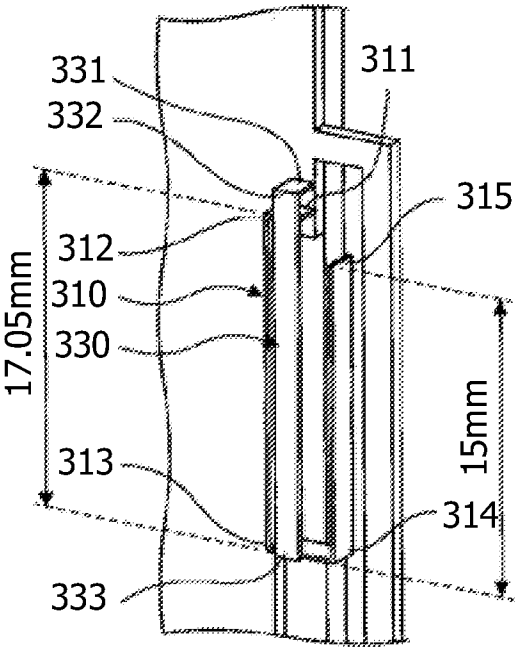
Figure 29C:
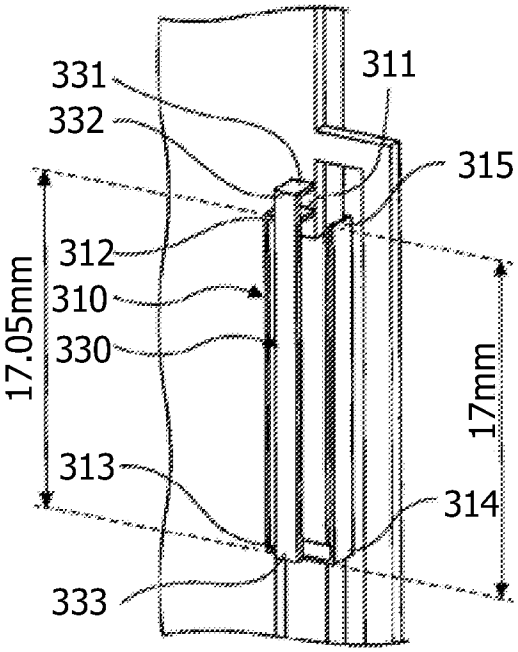

In the following, description is given of influence on communications of the length of the section between the bending part 314 and the end 315, with reference to FIGS. 29A to 30. FIGS. 29A to 29C are diagrams illustrating the antenna element 310 having a different length of the section between a bending part 314 and an end 315. Note that a length of the section between the bending parts 312 and 313 is 17.05 mm.

Figure 30:
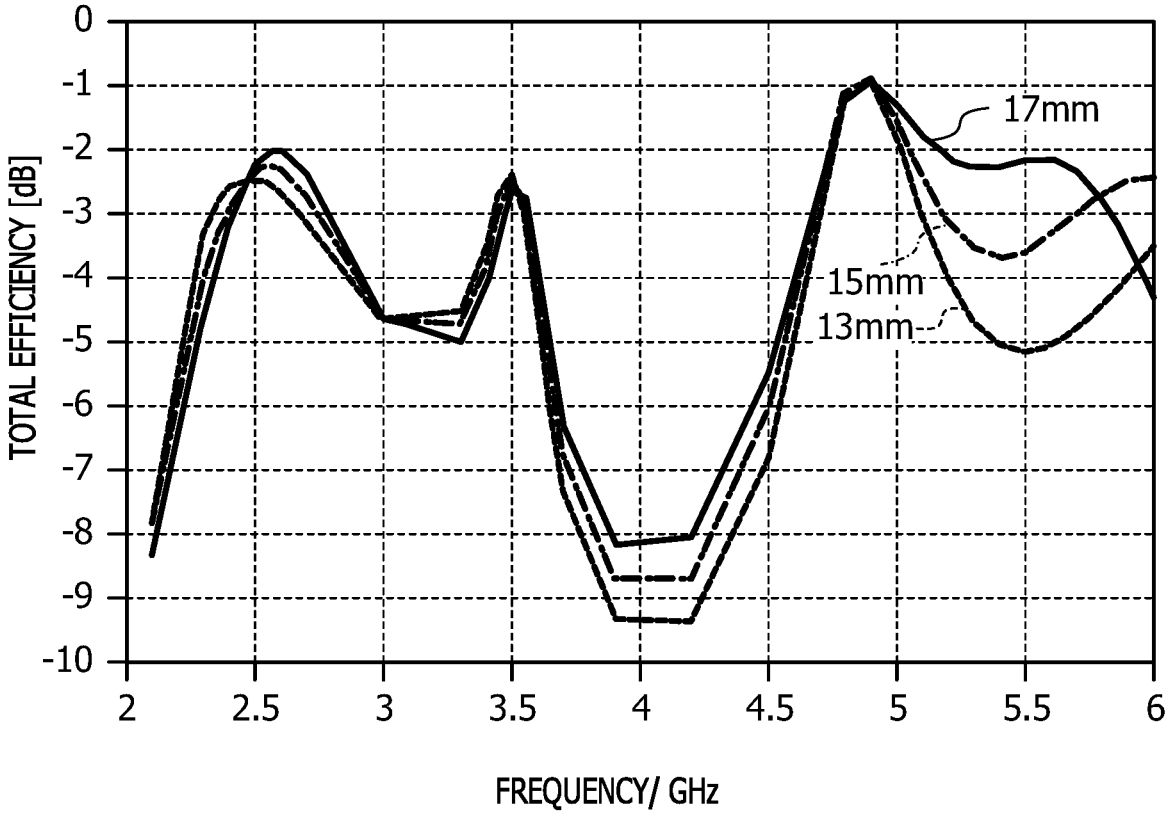
FIG. 30 is a diagram illustrating a difference in the frequency characteristics of the total efficiency due to the different length of the section between the bending part and the end.

When the length of the section between the bending part 314 and the end 315 is set to 13 mm (see FIG. 29A), 15 mm (see FIG. 29B), and 17 mm (see FIG. 29C), simulation results of the frequency characteristics of the total efficiency as illustrated in FIG. 30 are obtained. FIG. 30 is a diagram illustrating a difference in the frequency characteristics of the total efficiency due to the different length of the section between the bending part 314 and the end 315.

As illustrated in FIG. 30, in all of the f1 band around 2.45 GHz, the f2 band around 5 GHz, and the f3 band around 3.5 GHz, as the length of the section between the bending part 314 and the end 315 becomes longer, the higher total efficiency is obtained. This reveals that it is best to set the length of the section between the bending part 314 and the end 315 to 17 mm. It is believed that this is because the section where coupling of the antenna element 310 and the frame part 55 occurs is long, thus improving the characteristics.

Figure 31:
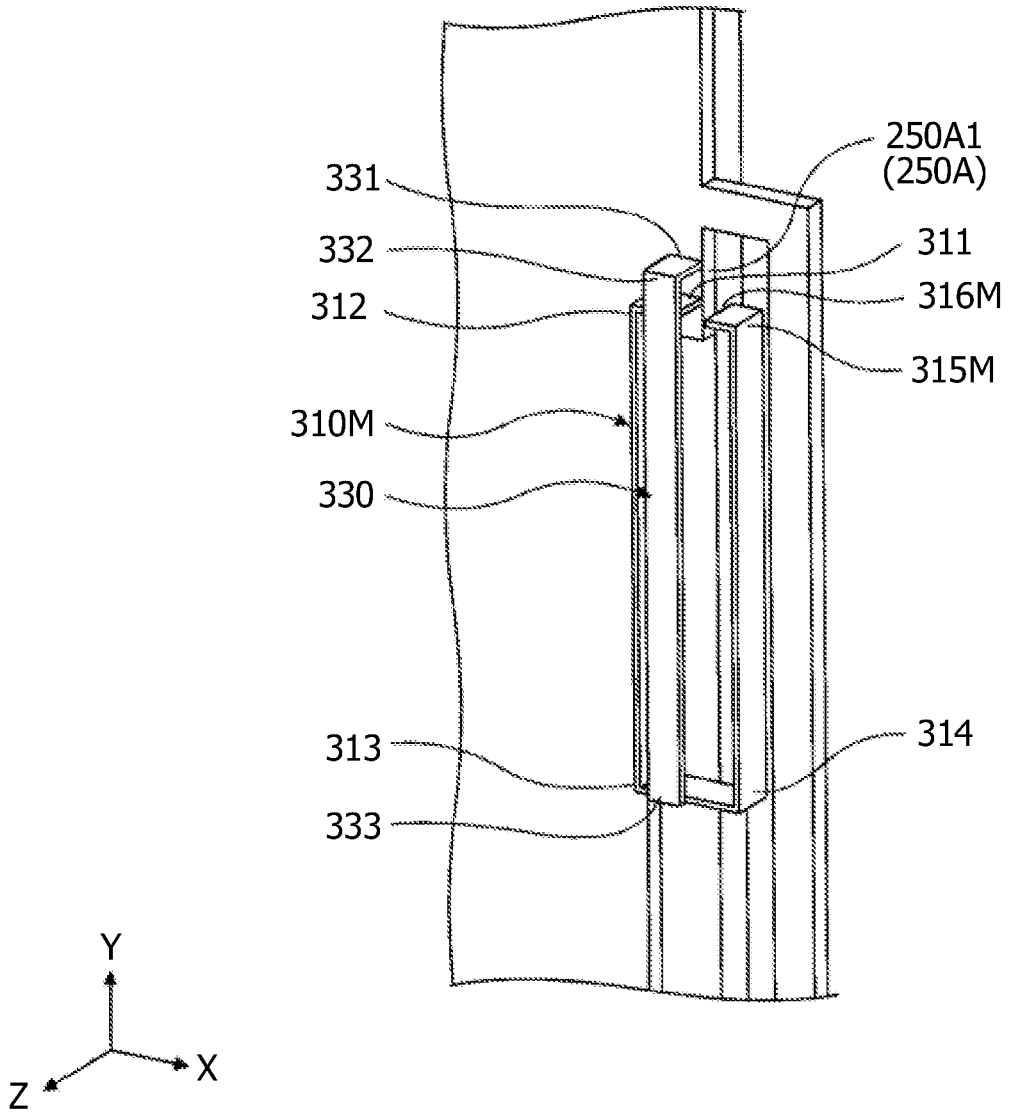
FIG. 31 is a diagram illustrating an antenna element of a modification example of an embodiment 3.

FIG. 31 is a diagram illustrating the antenna element 310M of a modification example of the embodiment 3. FIG. 31 corresponds to FIG. 24 and illustrates peripheral components other than the antenna element 310M.

The antenna element 310M includes the feeding point 311, the bending parts 312, 313, 314, and 315M, and an end 316M.

The antenna element 310M includes the bending part 315M instead of the end 315 of the antenna element 310 illustrated in FIG. 24, is bent to the X axis negative direction at the bending part 315M, and extends to the end 316M.

A section between the bending part 315M and the end 316M is a metal layer parallel to the XZ plane. The end 316M extends to a front side of the edge 250A1 and the parasitic element 330, in planar view.

Figure 32A:
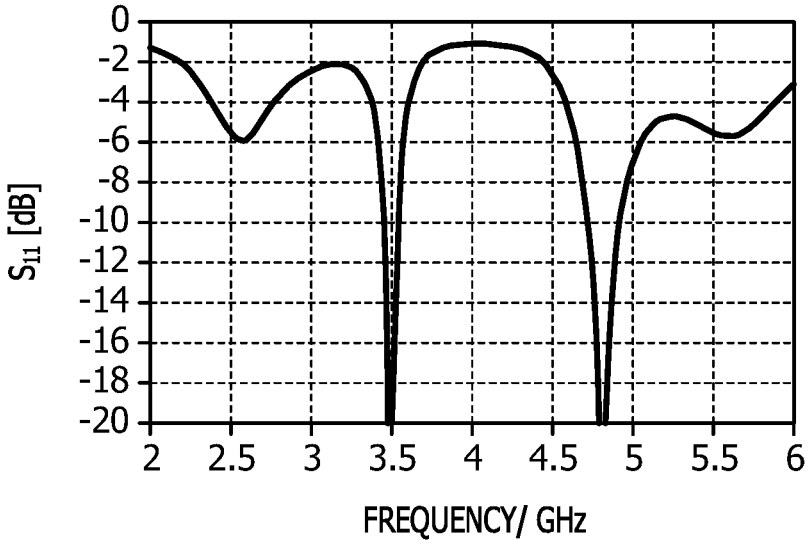
FIGS. 32A and 32B are diagrams illustrating a simulation result of frequency characteristics of a parameter and a total efficiency of the antenna device including the antenna element of the modification example of the embodiment 3.
Figure 32B:
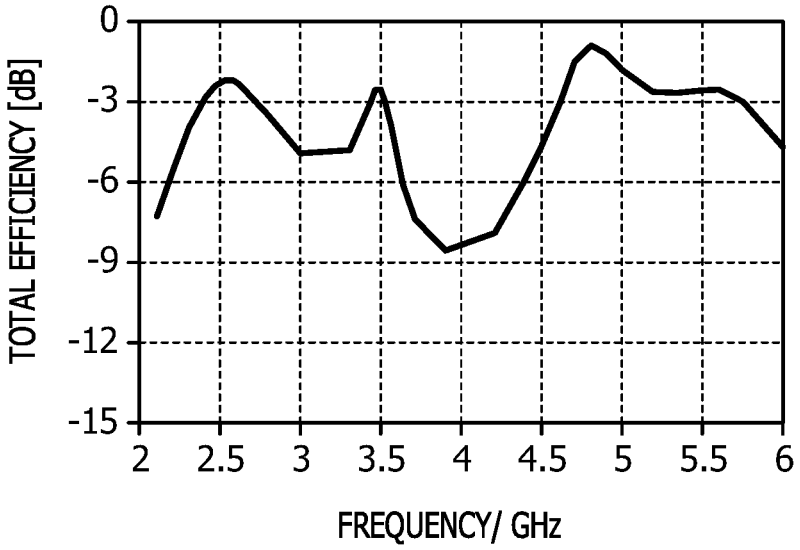

FIGS. 32A and 32B are diagram illustrating simulation results of the frequency characteristics of the $S_{11}$ parameter and the total efficiency of the antenna device including the antenna element 310M of the modification example of the embodiment 3.

In FIG. 32A, the horizontal axis represents the frequency and the vertical axis represents the value of the $S_{11}$ parameter. As illustrated in FIG. 32A, the $S_{11}$ parameter is approximately −6 dB at 2.6 GHz in the f1 band, −20 dB or lower at 4.8 GHz in the f2 band, and −20 dB or lower at 3.5 GHz in the f3 band.

Around the three frequencies, the band where the $S_{11}$ parameter value is low to some extent is obtained. Thus, it is possible to confirm that communications are enabled in the three bands of the f1 band (2.45 GHz band), the f2 band (5 GHz band), and the f3 band (3.5 GHz band).

In addition, as illustrated in FIG. 32B, a good value is obtained for the total efficiency, such as approximately −2.5 dB at 2.6 GHz, approximately −1.2 dB at 4.8 GHz, and approximately −2.5 dB at 3.5 GHz. Thus, also around the three frequencies, a band where the total efficiency is high to some extent is obtained.

In this manner, communications are enabled in the three frequency bands, even using the antenna element 310M that has the section between the bending part 315M and the end 316M.

Note that the section between the bending part 315M and the end 316M may be added to the end 215 of the antenna element 210 of the embodiment 2.

Embodiment 4

Figure 33:
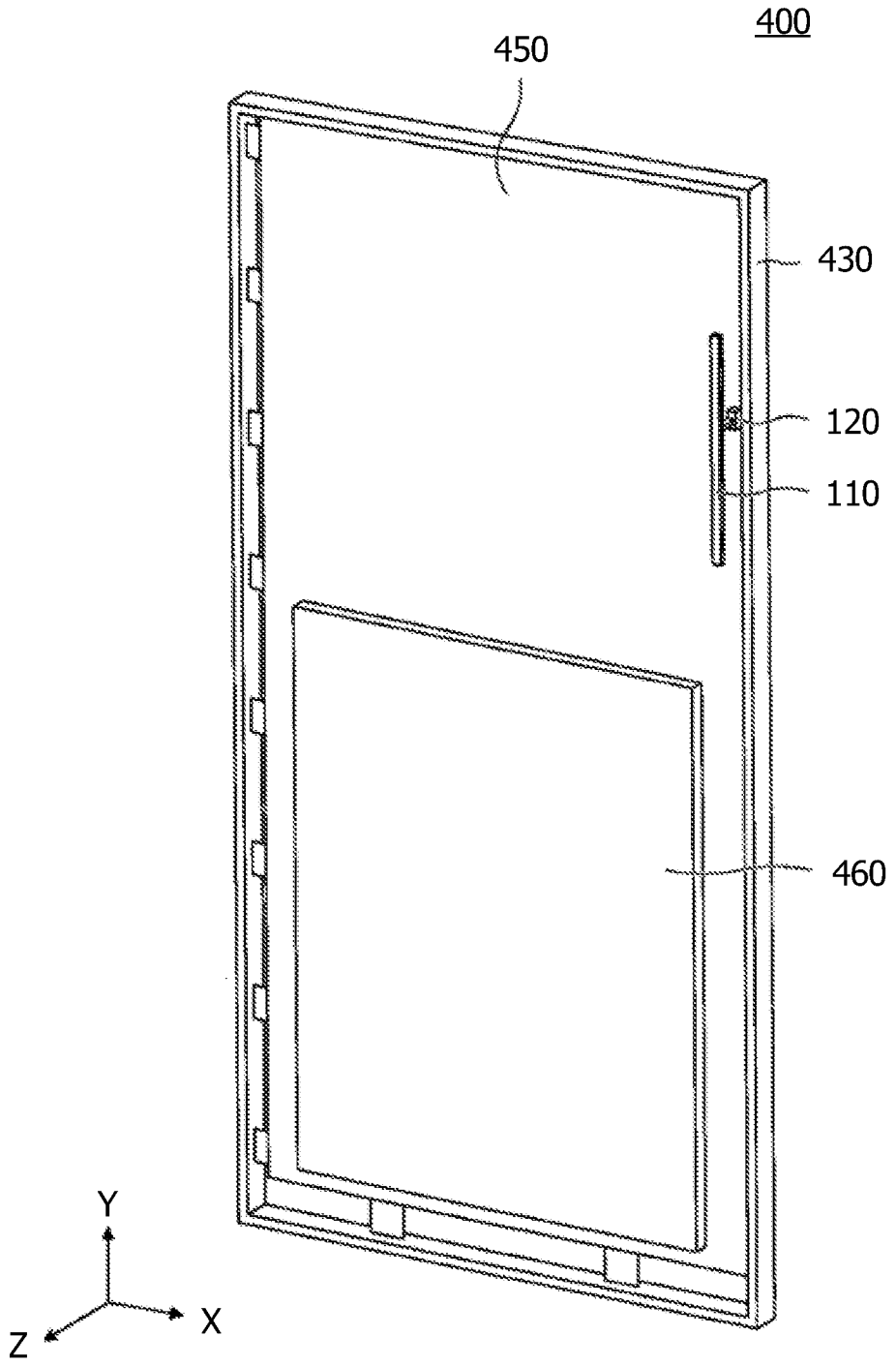
FIG. 33 is a perspective view of an antenna device of an embodiment 4.
Figure 34:
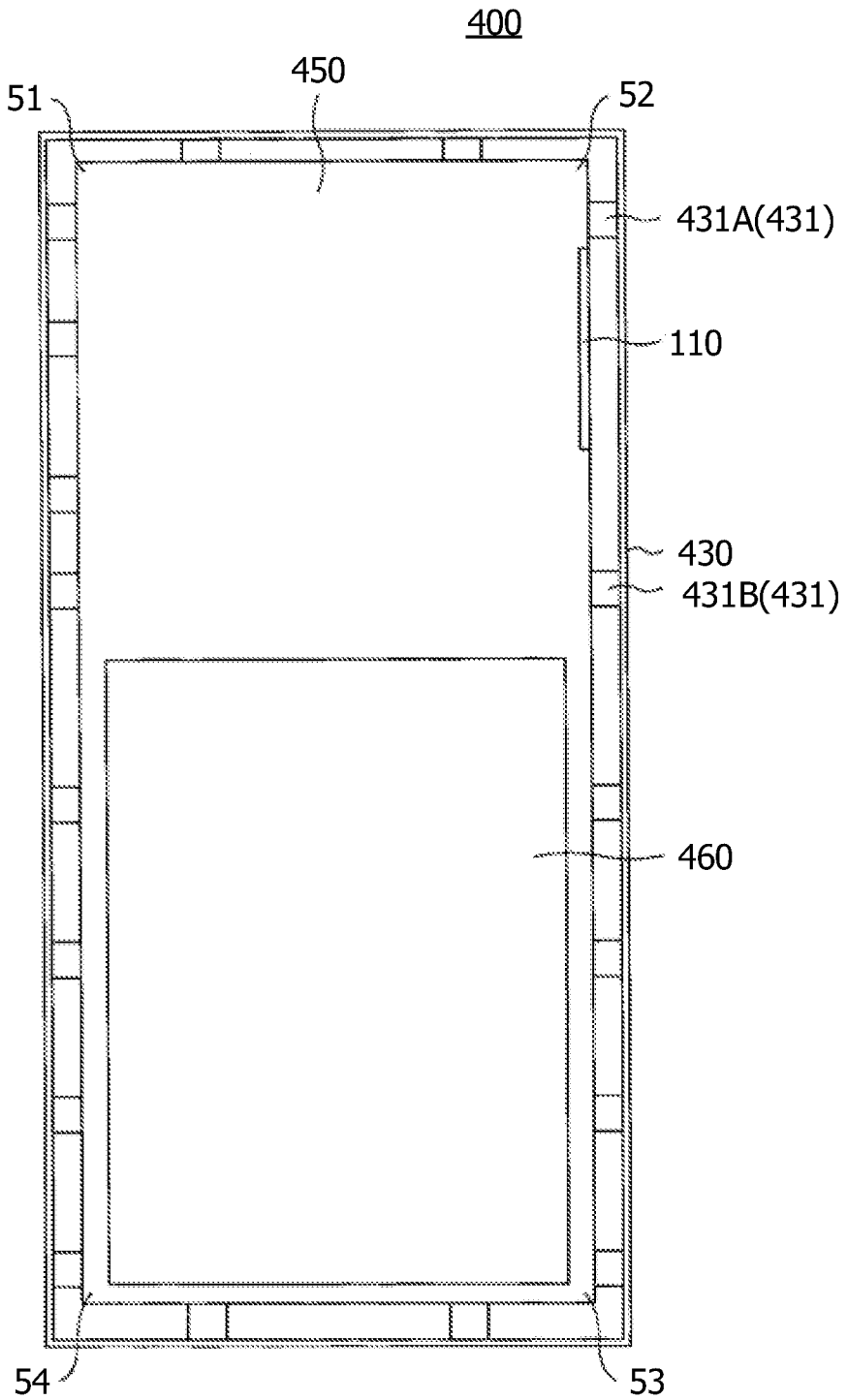
FIG. 34 is atop view of the antenna device of the embodiment 4.

FIGS. 33 and 34 are a perspective view and a top view of an antenna device 400 of an embodiment 4.

The antenna device 400 includes a ground plane 450, a metal plate 430, the antenna element 110, and the matching circuit 120. The antenna device 400 is placed in the tablet computer 500 (see FIG. 1) having the communication capability. Note that in FIGS. 16 and 17, the wiring board 505 is omitted.

In the antenna device 400 of the embodiment 4, the ground plane 50 of the antenna device 100 of the embodiment 1 is replaced with the ground plane 450 and the metal plate 430 is mounted around the ground plane 450.

A battery 460 is disposed on the surface 50B side of the ground plane 450 on the Y axis negative direction side. Other configuration is similar to the antenna device 100 of the embodiment 1. Same reference numerals are assigned to same components, and description of those components is omitted.

The metal plate 430 is a rectangular ring-shaped metallic sheet, surrounding the ground plane 450. The metal plate 430 is thin in the X axis direction and the Y axis direction and has a predetermined width in the Z axis direction. The metal plate 430 is connected to a periphery of the ground plane 450 by 18 connecting parts 431. Thus, the metal plate 430 is retained at the ground potential. A part or all of the metal plate 430 may be exposed to the side surface of the housing 500A (see FIG. 1). The metal plate 430 is disposed to cover four sides of the wiring board 505.

Of the 18 connecting parts 431, the two connecting parts 431 which are closest to the antenna element 110 are referred to as connecting parts 431A and 4318. The connecting part 431A is positioned on the Y axis positive direction side than the antenna element 110, and the connecting part 4318 is positioned on the Y axis negative direction side than the antenna element 110.

Of the metal plate 430, a section between the connecting parts 431A and 4318 has a similar configuration to the connecting ends 55A and 55D of the frame part 55 as illustrated in FIGS. 3 and 4. Thus, in the antenna device 400, similarly to the antenna device 100 of the embodiment 1, an electric current flows to the section between the connecting parts 431A and 4318 of the metal plate 430, and the antenna element 110 and the metal plate 430 are coupled. Of the metal plate 430, at least the section between the connecting parts 431A and 4318 is an example of a protruding metal member.

As described above, the configuration may be such that the frame part 55 of the antenna device 100 is replaced with the metal plate 430. Here, although description is given of the mode where the frame part 55 of the antenna device 100 of the embodiment 1 is replaced with the metal plate 430, the frame part 55 of the antenna devices 200 and 300 of the embodiments 2 and 3 may be replaced.

In addition, in the foregoing, description is given of the configuration in which the metal plate 430 is a rectangular ring-shaped member that surrounds the periphery of the ground plane 450. However, the metal plate 430 may be divided in the periphery of the ground plane 450, and may have a configuration that some functions as an antenna element or as a part of the antenna element.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. An antenna device comprising:

a ground plane that includes an edge and a surface;

a protruding metallic member that includes a first connecting part and a second connecting part coupled to the ground plane, protrudes from and in between two apexes of the edge in a direction perpendicular to the edge, and constructs a first loop which includes a portion of the edge; and a T-shaped antenna element that extends from a feeding point to a first end and a second end along the edge, the feeding point being disposed in a vicinity of the surface between the first connecting part and the second connecting part of the first loop, wherein a length of the first loop is set to an electric length of one wavelength in a first frequency, and is set to an electric length of two wavelengths in a second frequency that is a second order harmonic of the first frequency; and a second length from the feeding point of the T-shaped antenna element to the second end is shorter than a first length from the feeding point of the T-shaped antenna element to the first end, the second length corresponding to an electric length of a quarter wavelength in a third frequency, wherein a total length of the edge between the two apexes is longer than a length of the protruding metallic member, and the first loop is element that communicates by receiving power fed from T-shaped antenna element.

2. The antenna device according to claim 1 further comprising:

a branching line that branches at a branching point and extends to the edge, the branching point being closer to the first connecting part than to a midpoint of the first connecting part and the second connecting part of the protruding metallic member; and a matching circuit placed between a tip of the branching line and the edge, wherein a length of a second loop corresponds to the electric length of one wavelength in the first frequency and corresponds to the electric length of two wavelengths in the second frequency, the second loop being constructed by a section between the second connecting part of the protruding metallic member and the branching point, the branching line, the matching circuit, and a section between the matching circuit on the edge and the second connecting part.

3. The antenna device according to claim 1, wherein the protruding metallic member includes a first section extending from the first connecting part to a first bending part to a direction spaced from the edge; a second section being bent at the first bending part along the edge and extending to a second bending part;

and a third section being bent at the second bending part to the edge and extending to the second connecting part.

* * * * *